US009437937B2

(12) United States Patent
Tamaki et al.

(10) Patent No.: US 9,437,937 B2
(45) Date of Patent: Sep. 6, 2016

(54) TERMINAL AND CONNECTOR HAVING THE SAME

(71) Applicant: HOSIDEN CORPORATION, Yao-shi (JP)

(72) Inventors: Fumitake Tamaki, Yao (JP); Akihiro Tanaka, Yao (JP); Toshiharu Miyoshi, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 14/493,801

(22) Filed: Sep. 23, 2014

(65) Prior Publication Data

US 2015/0093941 A1 Apr. 2, 2015

(30) Foreign Application Priority Data

Sep. 27, 2013 (JP) ..... 2013-200977

(51) Int. Cl.

*H01R 13/10* (2006.01)
*H01R 4/18* (2006.01)
*H01R 13/11* (2006.01)
(Continued)

(52) U.S. Cl.

CPC ..... *H01R 4/18* (2013.01); *H01R 13/113* (2013.01); *H01R 13/631* (2013.01); *H01R 24/20* (2013.01)

(58) Field of Classification Search

CPC ..... H01R 13/113; H01R 24/20; H01R 4/18; H01R 13/631; H01R 13/41; H01R 13/4226; H01R 24/76

USPC ..... 439/682, 595, 733.1, 751, 843, 845, 439/851, 852, 862

See application file for complete search history.

(56) References Cited

U.S. PATENT DOCUMENTS 3,665,378 A * 5/1972 Hammell ..... H01R 13/428 439/748
3,963,302 A * 6/1976 Gourley ..... H01R 13/428 439/851

(Continued)

FOREIGN PATENT DOCUMENTS

| | | |
|---|---|---|
| JP | S53-2690 | 6/1976 |
| JP | S58-37674 | 9/1981 |
| WO | 2010088580 A1 | 8/2010 |

OTHER PUBLICATIONS

Extended European Search Report issued on Jan. 26, 2015 for the counterpart European patent application No. 14250108.9.

*Primary Examiner* — Neil Abrams
*Assistant Examiner* — Travis Chambers
(74) *Attorney, Agent, or Firm* — Kratz, Quintos & Hanson, LLP

(57) ABSTRACT

A terminal including a first fixable portion, a second fixable portion, a joining portion, and a first contacting portion. The first fixable portion has a dimension in a second direction, the dimension allowing the first fixable portion to be fixed to a first portion of an accommodation hole of a body. The second fixable portion is spaced from the first fixable portion in a first direction and has a dimension in the second direction allowing the second fixable portion to be fixed to a second portion of the accommodation hole. The joining portion joins the first and second fixable portions and has a dimension in the second direction that is smaller than the respective dimensions in the second direction of the first and second fixable portions. The first contacting portion extends from the first fixable portion toward the second fixable portion and is resiliently deformable in the second direction.

20 Claims, 11 Drawing Sheets

(51) Int. Cl.
*H01R 13/631* (2006.01)
*H01R 24/20* (2011.01)

(56) References Cited

U.S. PATENT DOCUMENTS 4,722,704 A * 2/1988 VanDerStuyf ..... H01R 13/114 439/851
4,907,990 A * 3/1990 Bertho ..... H01R 43/16 439/682
4,984,998 A * 1/1991 Duncan ..... H01R 13/4367 439/352
5,607,328 A * 3/1997 Joly ..... H01R 13/11 439/851
5,611,717 A * 3/1997 Joly ..... H01R 13/14 439/252
5,947,777 A 9/1999 Chaillot et al.
6,010,377 A * 1/2000 Dechelette ..... H01R 13/11 439/851
6,083,024 A * 7/2000 Mezin ..... H01R 13/113 439/268
7,201,617 B2 * 4/2007 Okamoto ..... H01R 13/114 439/851
8,790,143 B2 * 7/2014 Yang ..... H01R 13/14 439/852

* cited by examiner

TERMINAL AND CONNECTOR HAVING THE SAME

CROSS-REFERENCE TO RELATED APPLICATIONS

The present application claims priority under 35 U.S.C. §119 of Japanese Patent Application No. 2013-200977 filed on Sep. 27, 2013, the disclosure of which is expressly incorporated by reference herein in its entity.

BACKGROUND OF THE INVENTION

1. Technical Field

The invention relates to a terminal and a connector having the same.

2. Background Art

Japanese Utility Model Application Laid-Open Nos. 53-2690 (Patent Literature 1) and 58-37674 (Patent Literature 2) each describe a terminal for connection with a pin of a mating connector. The terminal is accommodated in the accommodation hole of a body made of an insulation resin. The terminal has a plate-shaped base, a pair of projections, and a pair of contacting portions. The projections stand on widthwise ends of the base. The contacting portions are arms extending from the projections toward one lengthwise side (distal side) of the base, and they are bent in a generally V-shape such as to be closer to each other in the middle. When the pin of the mating connector is inserted between the contacting portions, the contacting portions resiliently deform in directions away from each other to resiliently hold the pin therebetween. This is how the terminal is connected to the pin of the mating connector.

SUMMARY OF INVENTION

In the terminal of Patent Literature 1, the distance between the outer faces in the width direction of the projections is larger than the width dimension of the base. When the terminal is accommodated in the accommodation hole of the body, the projections abut the wall surfaces in the width direction of the accommodation hole. However, the base extends in spaced relation to the wall surfaces. Accordingly, when the pin of the mating connector is inserted between the contacting portions and presses one of the contacting portions at a larger load than the other contacting portion, there is a possibility of decentering of the distal portion of the terminal (the distal portion of the base and the distal portion of the one of the contacting portions) to either side in the width direction.

In the terminal in Patent Literature 2, the distance between the outer faces in the width direction of the projections is substantially the same as the widthwise dimension of the portion excluding the distal portion (the remaining portion) of the base, and the projections and the remaining portion of the base abut the wall surfaces in the width direction of the accommodation hole. Accordingly, even when the pin of the mating connector is inserted between the contacting portions and presses one of the contacting portions at a larger load than the other contacting portion, the distal portion of the terminal (the distal portion of the base and the distal portion of the one of the contacting portions) is unlikely to be decentered to either side in the width direction. However, the projections and the remaining portion of the base are sized such as to abut the wall surfaces in the width direction of the accommodation hole, making it difficult to accommodate the terminal into the accommodation hole of the body.

The invention has been contrived in view of the above circumstances and provides a terminal that is unlikely to be decentered under a load and still easy to accommodate in an accommodation hole of a body. The invention also provides a connector having the connector.

A terminal according to an aspect of the invention includes a first fixable portion, a second fixable portion, a joining portion, and a first contacting portion. The first fixable portion has a dimension in a second direction crossing a first direction, the dimension allowing the first fixable portion to be fixed to a first portion of an accommodation hole of a body made of an insulation resin. The accommodation hole extends in the first direction. The second fixable portion is spaced from the first fixable portion in the first direction and has a dimension in the second direction allowing the second fixable portion to be fixed to a second portion of the accommodation hole of the body. The joining portion joins the first and second fixable portions and has a dimension in the second direction that is smaller than the respective dimensions in the second direction of the first and second fixable portions. The first contacting portion extends from the first fixable portion toward the second fixable portion and is resiliently deformable in the second direction.

In the terminal according to this aspect, the first and second fixable portions are fixed to two places (the first and second portions) of the accommodation hole of the body that are spaced from each other in the first direction. This arrangement can prevent decentering of the terminal in the second direction when the first contacting portion receives a load from the terminal of a mating connector and resiliently deforms in the second direction. In addition, the first and second fixable portions has dimensions allowing them to be fixed to the first and second portions, respectively, of the accommodation hole of the body, while the joining portion is smaller in dimension in the second direction than the first and second fixable portions. Therefore, the terminal can be accommodated into the accommodation hole of the body, without bringing the joining portion into contact with the body in the second direction. The terminal can thus be easily accommodated in the accommodation hole of the body.

The dimension in the first direction of the joining portion may be larger than the dimension in the first direction of the first contacting portion. The second fixable portion may be located on one side in the first direction with respect to the first contacting portion.

In the terminal according to this aspect, the second fixable portion is fixed to the second portion of the accommodation hole of the body on the one side in the first direction with respect to the first contacting portion. This arrangement can prevent decentering of the terminal in the second direction when the first contacting portion receives a load and resiliently deforms in the second direction.

The second fixable portion may include a base and a projection on the base. The sum of a dimension in a third direction of the base and a dimension in the third direction of the projection may be substantially the same as or slightly larger than a dimension in the third direction of the second portion of the accommodation hole. The third direction may cross the first and second directions.

In the terminal according to this aspect, the second fixable portion is fixed to the second portion of the accommodation hole of the body in the second and third directions. Therefore, the terminal can be stably accommodated in the accommodation hole of the body.

The first fixable portion may include a base, and a projection on the base of the first fixable portion. The sum of a dimension in the third direction of the base of the first fixable portion and a dimension in the third direction of the projection of the first fixable portion may be substantially the same as or slightly larger than a dimension in the third direction of the first portion of the accommodation hole. The third direction may cross the first and second directions.

In the terminal according to this aspect, the first fixable portion is fixed to the first portion of the accommodation hole of the body in the second and third directions. Therefore, the terminal can be stably accommodated in the accommodation hole of the body.

The base of the first fixable portion may include a first end on one side in the second direction, and a second end on the other side in the second direction. The projection of the first fixable portion may include first and second projections. The first projection may be provided at the first end of the base of the first fixable portion, and the second projection may be provided at the second end of the base of the first fixable portion. The distance in the second direction from an outer face of the first projection to an outer face of the second projection may be substantially the same as or slightly larger than the dimension in the second direction of the first portion of the accommodation hole of the body. In the terminal according to this aspect, the first fixable portion is fixed to the first portion of the accommodation hole of the body in the second direction by bringing the outer faces of the first and second projections into abutment with the first portion of the accommodation hole of the body.

The first contacting portion may include a fixed end fixed to the projection, and a free end opposite the fixed end of the first contacting portion. The relative positioning of the free end and a wall surface on one side in the second direction of the accommodation hole of the body may be such that (a) when the first contacting portion is located in an neutral position, there is a clearance between the free end and the wall surface on the one side, and (b) when the first contacting portion resiliently deforms from the neutral position to the one side in the second direction, the free end abuts the wall surface on the one side.

In the terminal according to this aspect, when the first contacting portion is in the neutral position, there is clearance between the free end and the wall surface on the one side. Therefore, the first contacting portion can resiliently deform to the one side in the second direction at light load when the terminal of the mating connector presses the first contacting portion. When the first contacting portion receives the load and resiliently deforms to the one side in the second direction, the free end is brought into abutment with the wall surface on the one side, increasing the contact pressure of the first contacting portion to the terminal of the mating connector.

The first contacting portion may further include a contactable portion between the fixed end and the free end. The contactable portion may be located on the other side in the second direction with respect to the fixed end and the free end. The distance in the first direction from the fixed end to the contactable portion may be larger than a distance in the first direction from the free end to the contactable portion. Alternatively, the distance in the first direction from the fixed end to the contactable portion may be smaller than a distance in the first direction from the free end to the contactable portion.

The terminal according to this aspect allow the first contacting portion to provide an optimum contact pressure to the terminal of the mating connector by setting the distance in the first direction from the fixed end to the contactable portion to a larger or smaller value than the distance in the first direction from the free end to the contactable portion.

The terminal may further include a first biasing portion extending from the second fixable portion toward the first fixable portion so as to be located on one side in the second direction of the first contacting portion. The first biasing portion may be resiliently deformable to the one side in the second direction when the first contacting portion resiliently deforms to the one side in the second direction and presses the first biasing portion to the one side in the second direction.

In the terminal according to this aspect, when the terminal of the mating connector presses the first contacting portion, the first biasing portion resiliently deforms together with the first contacting portion. The first biasing portion thereby biases the first contacting portion, increasing the contact pressure of the first contacting portion to the terminal of the mating connector.

The terminal may further include a second contacting portion. The projection of the first fixable portion may include first and second projections. The first contacting portion may extend from the first projection toward the second fixable portion and may be resiliently deformable to one side in the second direction. The second contacting portion may extend from the second projection toward the second fixable portion and may be resiliently deformable to the other side in the second direction.

In the terminal according to this aspect, when the terminal of the mating connector is inserted between the first and second contacting portions, the first contacting portion resiliently deforms to the one side in the second direction, the second contacting portion resiliently deforms to the other side in the second direction, and the first and second contacting portions resiliently holds therebetween the terminal of the mating connector. This arrangement can further increase the contact pressure of the first and second contacting portions to the terminal of the mating connector.

The first contacting portion may include a fixed end fixed to the first projection, and a free end opposite the fixed end of the first contacting portion. The relative positioning of the free end and a wall surface on the one side in the second direction of the accommodation hole of the body may be such that (a) when the first contacting portion is located in a neutral position, there is a clearance between the free end and the wall surface on the one side, and (b) when the first contacting portion resiliently deforms from the neutral position thereof to the one side in the second direction, the free end abuts the wall surface on the one side. The second contacting portion may include a fixed end fixed to the second projection, and a free end opposite the fixed end of the second contacting portion. The relative positioning of the free end of the second contacting portion and a wall surface on the other side in the second direction of the accommodation hole of the body may be such that (a) when the second contacting portion is located in a neutral position, there is a clearance between the free end of the second contacting portion and the wall surface on the other side, and (b) when the second contacting portion resiliently deforms from the neutral position thereof to the other side in the second direction, the free end of the second contacting portion abuts the wall surface on the other side.

In the terminal according to this aspect, when the first and second contacting portions are in the neutral positions, there is a clearance between the free ends and the wall surfaces on the one and other sides. Therefore, the first and second contacting portions can resiliently deform at light load when the terminal of the mating connector is inserted between the first and second contacting portions to press the first and second contacting portions. When the first and second contacting portions receive the load and resiliently deforms, the free ends of the first and second contacting portions are brought into abutment with the wall surfaces on the one and other side, increasing the contact pressure of the first and second contacting portions to the terminal of the mating connector.

The first contacting portion may further include a contactable portion provided between the fixed end and the free end. The contactable portion of the first contacting portion may be located on the other side in the second direction with respect to the fixed end and the free end of the first contacting portion. The distance in the first direction from the fixed end to the contactable portion of the first contacting portion may be larger than a distance in the first direction from the free end to the contactable portion of the first contacting portion. The second contacting portion may further include a contactable portion provided between the fixed end and the free end. The contactable portion of the second contacting portion may be located on the one side in the second direction with respect to the fixed end and the free end of the second contacting portion. The distance in the first direction from the fixed end to the contactable portion of the second contacting portion may be larger than a distance in the first direction from the free end to the contactable portion of the second contacting portion. Alternatively, the distance in the first direction from the fixed end to the contactable portion of the first contacting portion may be smaller than a distance in the first direction from the free end to the contactable portion of the first contacting portion, and the distance in the first direction from the fixed end to the contactable portion of the second contacting portion may be smaller than a distance in the first direction from the free end to the contactable portion of the second contacting portion.

The terminal according to this aspect allow first and second contacting portions to provide optimum contact pressures to the terminal of the mating connector by setting the distance in the first direction from the fixed end to the contactable portion of each of the first and second contacting portions to a larger or smaller value than the distance in the first direction from the free end to the contactable portion.

Still alternatively, the contactable portion of the first contacting portion may be located on the one side or the other side in the first direction with respect to the contactable portion of the second contacting portion. In the terminal according to this aspect, the first and second contacting portions are different in natural frequency. Therefore, even when the first and second contacting portions resiliently holding therebetween the terminal of the mating connector are subjected to vibration and/or physical shock, there is an increased possibility of maintaining connection between at least one of the first and second contacting portions and the terminal of the mating connector.

The terminal may further include a first biasing portion and a second biasing portion. The first biasing portion may extend from the second fixable portion toward the first fixable portion so as to be located on the one side in the second direction of the first contacting portion. The first biasing portion may be resiliently deformable to the one side in the second direction when the first contacting portion resiliently deforms to the one side in the second direction and presses the first biasing portion to the one side in the second direction. The second biasing portion may extend from the second fixable portion toward the first fixable portion so as to be located on the other side in the second direction of the second contacting portion. The second biasing portion may be resiliently deformable to the other side in the second direction when the second contacting portion resiliently deforms to the other side in the second direction and presses the second biasing portion to the other side in the second direction.

In the terminal according to this aspect, when the terminal of the mating connector is inserted between the first and second contacting portions to press the first and second contacting portions, the first biasing portion resiliently deforms together with the first contacting portion, and the second biasing portion resiliently deforms together with the second contacting portion. The first and second biasing portions thereby bias the first and second contacting portions, increasing the contact pressure of the first and second contacting portions to the terminal of the mating connector.

The joining portion may include an abutting face to abut a wall surface of the accommodation hole of the body, the abutting face including a recess or a hole.

The terminal may further include a connectable portion to be connected to a cable.

A connector according to an aspect of the invention includes the terminal of any one of the above aspects and a body. The body may be made of an insulation resin and include an accommodation hole. The accommodation hole may extend in the first direction and accommodating the terminal.

The second direction may include one side and the other side. The first contacting portion of the terminal may include a fixed end fixed to the first fixable portion, a free end opposite to the fixed end, and a contactable portion between the fixed end and the free end. The contactable portion may be located on the other side in the second direction with respect to the fixed end and the free end. The body may include an accommodation hole extending in the first direction and accommodating the terminal, and an insertion hole on the one side in the first direction with respect to the accommodation hole of the body. The insertion hole may include a wall surface on the one side in the second direction, the wall surface being located on the other side in the second direction with respect to the free end of the first contacting portion.

In the connector according to this aspect, when the terminal of the mating connector is inserted through the insertion hole of the body into the body, the terminal of the mating connector does not collide with the free end of the first contacting portion. This is because the wall surface on the one side in the second direction of the insertion hole is located on the other side (the inner side) in the second direction with respect to the free end of the first contacting portion. Hence, this arrangement can prevent buckling of the first contacting portion due to collision of the terminal of the mating connector with the free end of the first contacting portion.

The first and second contacting portions of the terminal may each include a fixed end fixed to the first fixable portion, a free end opposite to the fixed end, and a contactable portion between the fixed end and the free end. The contactable portion of the first contacting portion may be located on the other side in the second direction with respect to the fixed end and the free end of the first contacting portion. The contactable portion of the second contacting portion may be located on the one side in the second direction with respect to the fixed end and the free end of the second contacting portion. The body may include an accommodation hole extending in the first direction and accommodating the terminal, and an insertion hole on the one side in the first direction with respect to the accommodation hole of the body. The insertion hole may include a wall surface on the one side in the second direction located on the other side in the second direction with respect to the free end of the first contacting portion, and a wall surface on the other side in the second direction located on the one side in the second direction with respect to the free end of the second contacting portion.

In the connector according to this aspect, when the terminal of the mating connector is inserted through the insertion hole of the body into the body, the terminal of the mating connector does not collide with the free ends of the first and second contacting portions. This is because the wall surface on the one side in the second direction of the insertion hole is located on the other side (the inner side) in the second direction with respect to the free end of the first contacting portion, while the wall surface on the other side in the second direction of the insertion hole is located on the one side (the inner side) in the second direction with respect to the free end of the second contacting portion. Hence, this arrangement can prevent buckling of the first and second contacting portions due to collision of the terminal of the mating connector with the free ends of the first and second contacting portions.

DESCRIPTION OF EMBODIMENTS

Figure 1A:
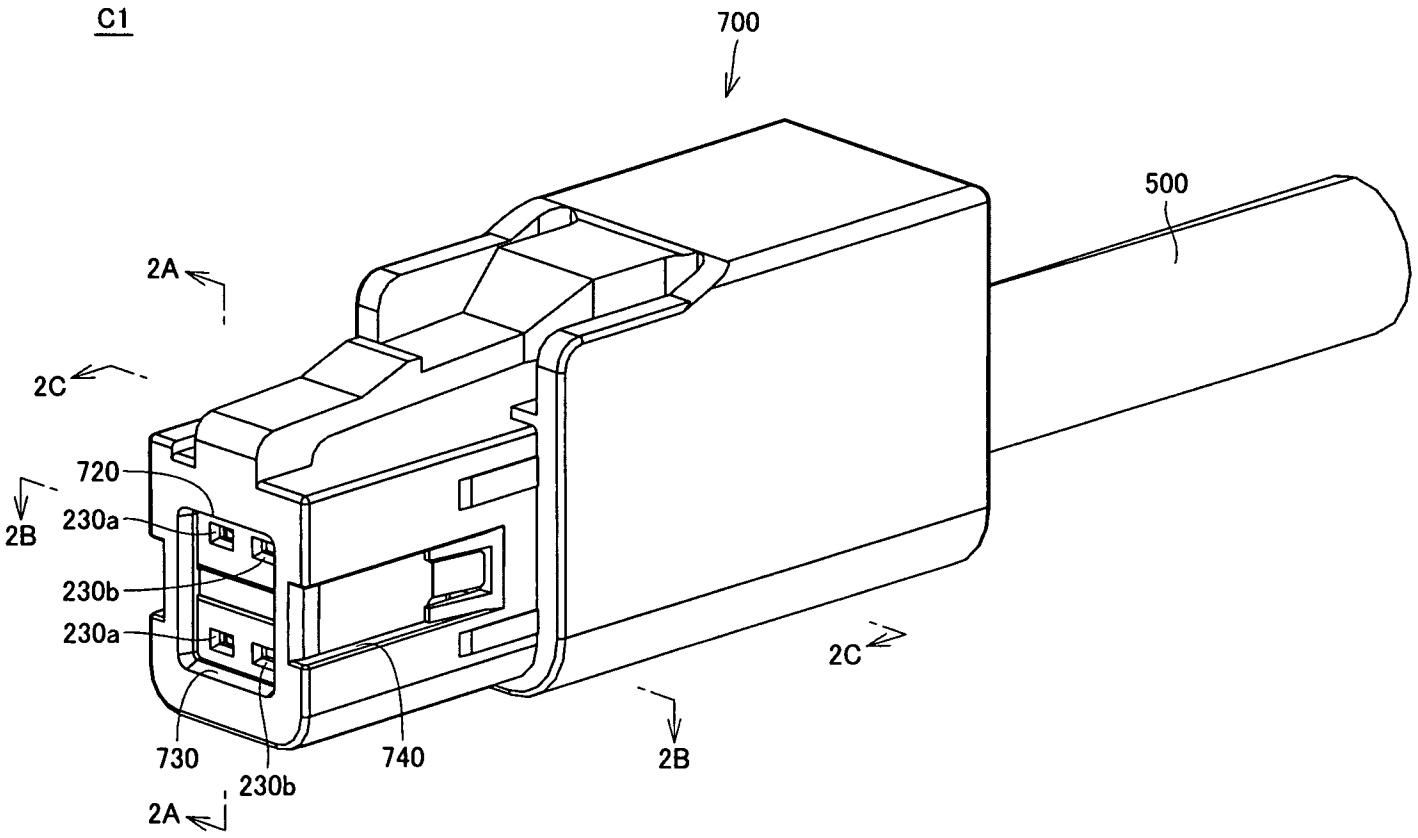
FIG. 1A is a front, top, right side perspective view of a connector according to Embodiment 1 of the invention.
Figure 1B:
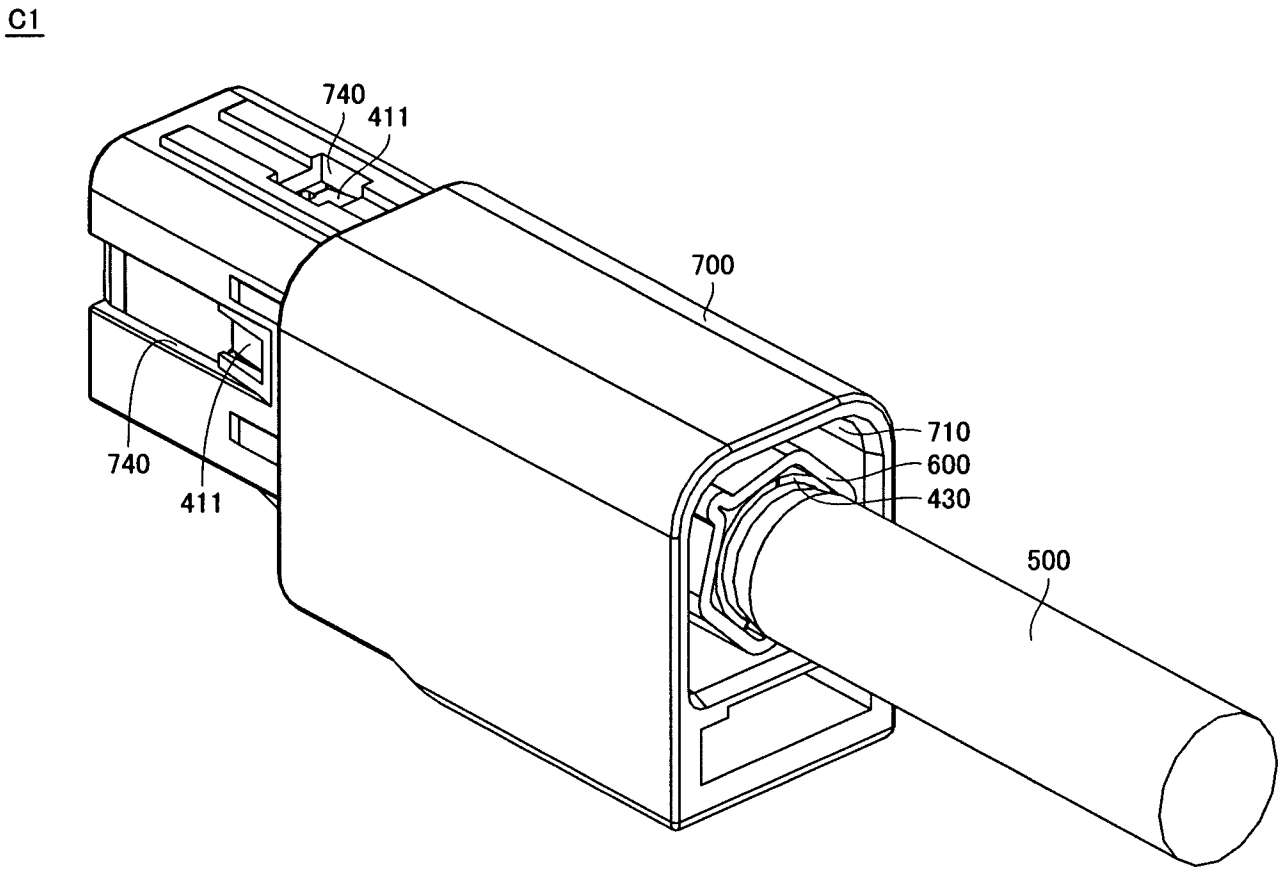
FIG. 1B is a rear, bottom, left side perspective view of the connector.

Embodiments 1 and 2 of the invention will be described below.

Embodiment 1

A connector C1 according to Embodiment 1 of the invention will be described below with reference to FIGS. 1A to 5. As shown in FIGS. 1A to 3B, the connector C1 includes two terminals 100*a* (corresponding to the terminal in the claims), two terminals 100*b* (corresponding to the terminal in the claims), a body 200, a shield plate 300, a shield case 400, a cable 500, a ring 600, and a case 700. These constituents of the connector C1 will be described below in detail. It should be noted that, the Y-Y' direction shown in FIGS. 2A, 2B, and 3A to 4B is the length direction of the connector C1 and corresponds to the first direction in the claims. In the Y-Y' direction, the Y direction of corresponds to one side in the first direction in the claims, and the Y' direction corresponds to the other side in the first direction in the claims. The Z-Z' direction shown in FIGS. 2A, 2C, and 3A to 4B is the height direction of the connector C1 and corresponds to the second direction in the claims. In the Z-Z' direction, the Z direction corresponds to one side in the second direction in the claims, and the Z' direction corresponds to the other side in the second direction in the claims. The X-X' direction shown in FIGS. 2B to 4B is the width direction of the connector C1 and corresponds to the third direction in the claims. In the X-X' direction, the X direction corresponds to one side in the third direction, and the X' direction corresponds to the other side in the third direction. The Z-Z' direction is substantially perpendicular to the Y-Y' direction. The X-X' direction is substantially perpendicular to the Y-Y' and Z-Z' directions.

Figure 2A:
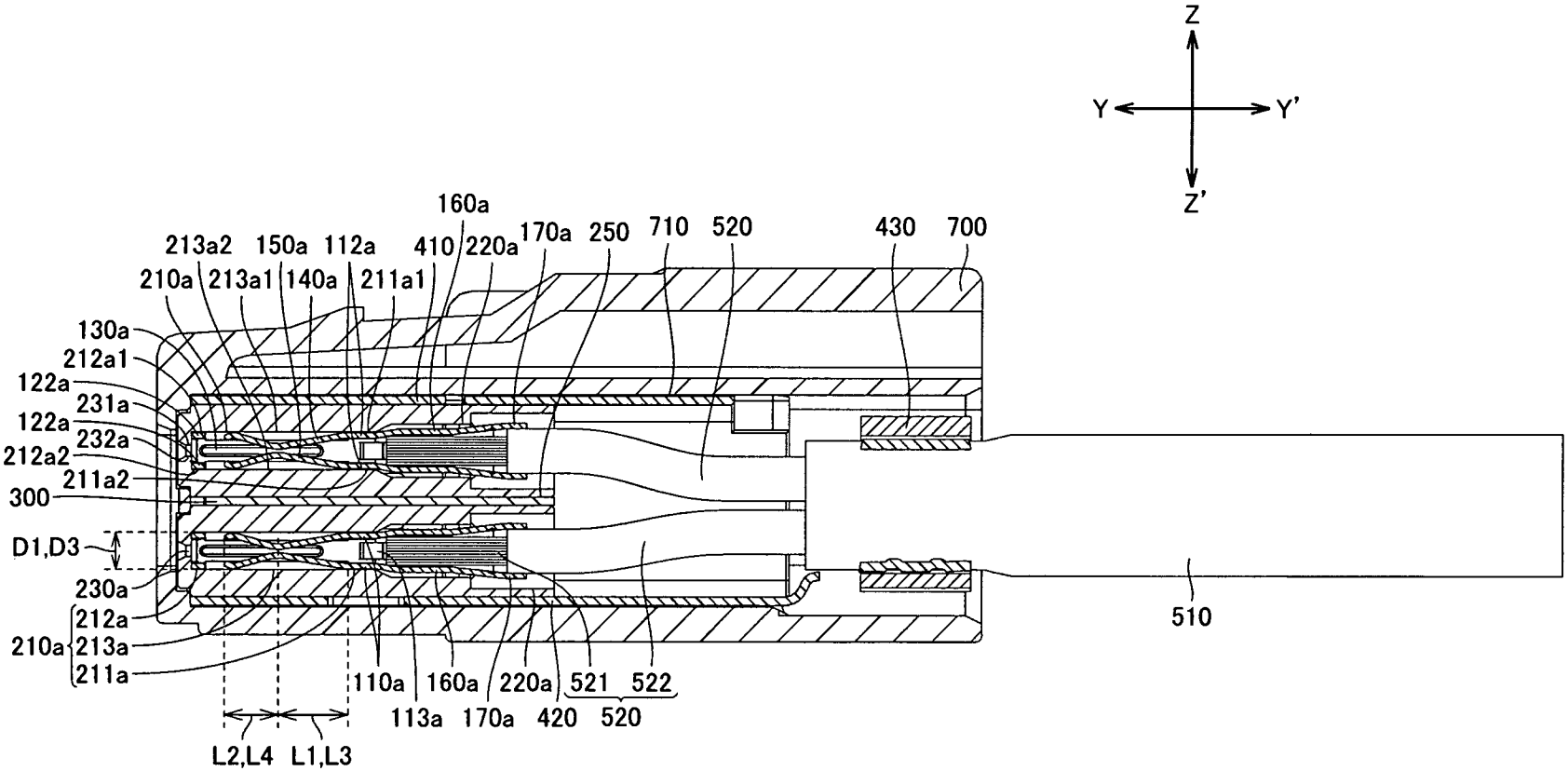
FIG. 2A is a cross-sectional view of the connector taken along line 2A-2A in FIG. 1A.
Figure 2B:
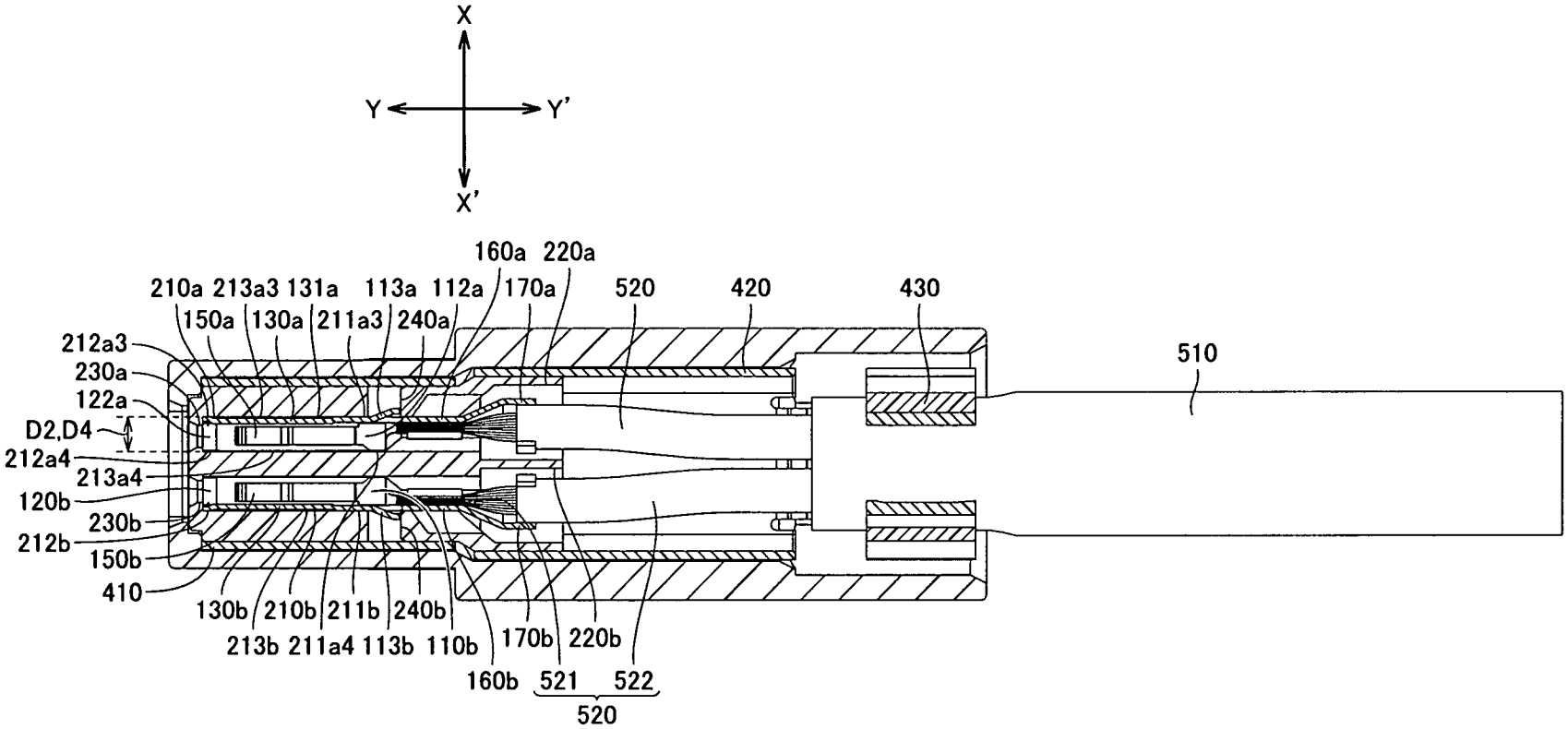
FIG. 2B is a cross-sectional view of the connector taken along line 2B-2B in FIG. 1A.
Figure 2C:
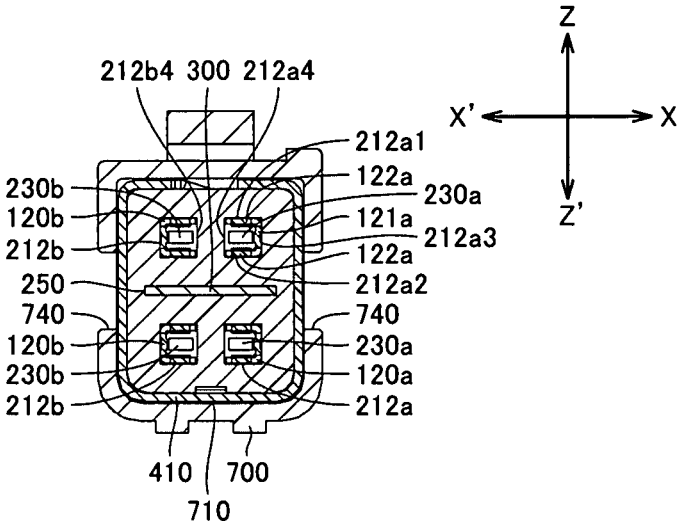
FIG. 2C is a cross-sectional view of the connector taken along line 2C-2C in FIG. 1A.
Figure 3A:
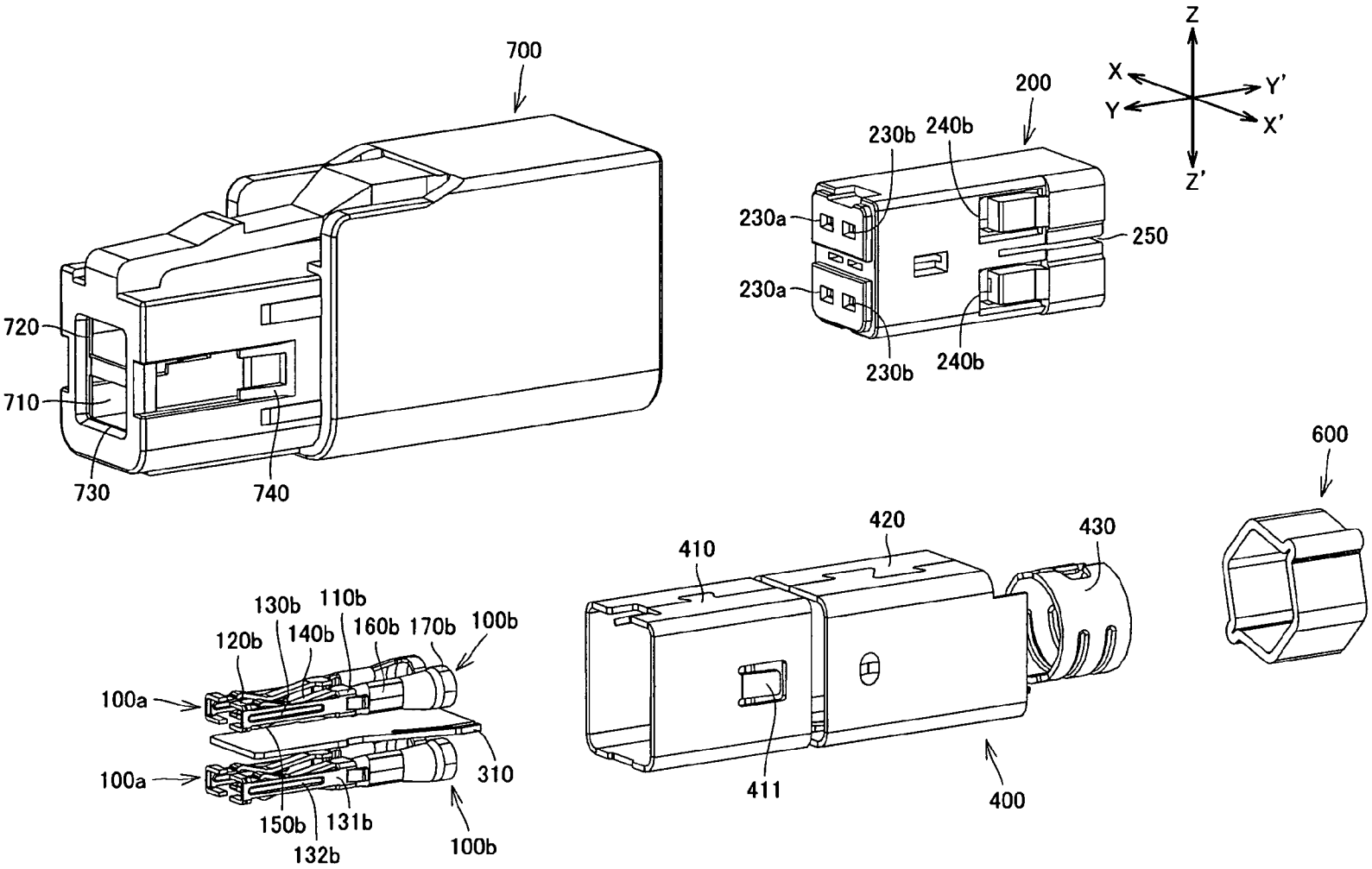
FIG. 3A is an exploded, front, top, right side perspective view of the connector, excluding the cable.
Figure 3B:
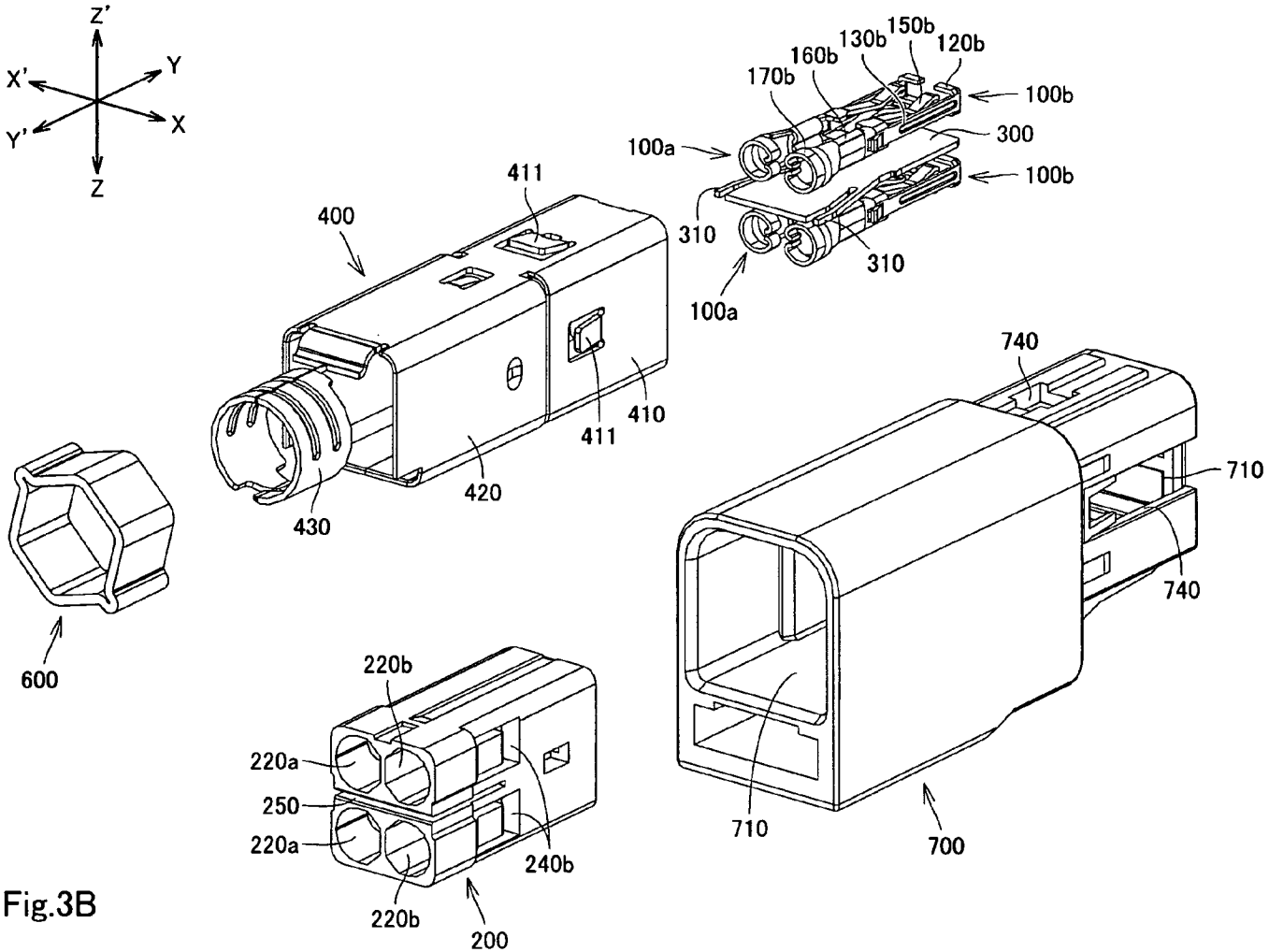
FIG. 3B is an exploded, rear, bottom, left side perspective view of the connector, excluding the cable.

As best shown in FIGS. 3A and 3B, the body 200 is a block made of an insulation resin. As shown in FIGS. 2A to 3B, the body 200 includes two accommodation holes 210*a* (corresponding to the accommodation hole in the claims), two accommodation holes 210*b* (corresponding to the accommodation hole in the claims), two cable accommodation holes 220*a*, two cable accommodation holes 220*b*, two insertion holes 230*a* (corresponding to the insertion hole in the claims), two insertion holes 230*b* (corresponding to the insertion hole in the claims), two engaging grooves 240*a*, two engaging grooves 240*b*, and a slit 250.

As best shown in FIG. 2A, the two accommodation holes 210*a* are provided in the portion on the X-direction side of the body 200, in spaced relation to each other in the Z-Z' direction. Each of the accommodation holes 210*a* is a square hole extending in the Y-Y' direction. Each accommodation hole 210*a* includes a first portion 211*a*, a second portion 212*a*, and a third portion 213*a*. The first portion 211*a* is the Y' direction end portion the accommodation hole 210*a*. The second portion 212*a* is the Y direction end portion of the accommodation hole 210*a*. The third portion 213*a* is a portion between the first portion 211*a* and the second portion 212*a*. The first portion 211*a*, the second portion 212*a*, and the third portion 213*a* have the same shape. The first portion 211*a* has a wall surface 211*a*1 on the Z-direction side, a wall surface 211*a*2 on the Z'-direction side, a wall surface 211*a*3 on the X-direction side (see FIG. 2B), and a wall surface 211*a*4 on the X'-direction side (see FIG. 2B). The second portion 212*a* has a wall surface 212*a*1 on the Z-direction side, a wall surface 212*a*2 on the Z'-direction side, a wall surface 212*a*3 on the X-direction side (see FIG. 2B), and a wall surface 212*a*4 on the X'-direction side (see FIG. 2B). The third portion 213*a* has a wall surface 213*a*1 on the Z-direction side, a wall surface 213*a*2 on the Z'-direction side, a wall surface 213*a*3 on the X-direction side (see FIG. 2B), and a wall surface 213*a*4 on the X'-direction side (see FIG. 2B).

The two accommodation holes 210*b* are provided in the X' direction portion of the body 200, in spaced relation to each other in the Z-Z' direction. The accommodation holes 210*b* is square holes, the same shape as the accommodation hole 210*a*, and that the accommodation hole 210*b* are symmetrically opposed to the accommodation hole 210*a* in the X-X' direction. Each accommodation hole 210*b* includes a first portion 211*b*, a second portion 212*b*, and a third portion 213*b*.

The cable accommodation holes 220*a* of the body 200 are provided on the Y'-direction side with respect to the accommodation hole 210*a* of the body 200 so as to communicate with the respective accommodation holes 210*a*. The cable accommodation holes 220*a* are open in the Y' direction. The cable accommodation holes 220*b* of the body 200 are provided on the Y'-direction side with respect to the accommodation hole 210*b* of the body 200 so as to communicate with the respective accommodation holes 210*b*. The cable accommodation holes 220*b* are open in the Y' direction.

The insertion holes 230*a* of the body 200 are rectangular holes on the Y-direction side with respect to the accommodation holes 210*a* of the body 200 so as to communicate with the respective accommodation holes 210*a* of the body 200. The insertion holes 230*a* are open in the Y direction. As shown in FIG. 2B, each insertion hole 230*a* is smaller in cross-sectional shape in the Z-Z' direction than each accommodation hole 210*a*. Each insertion hole 230*a* includes a wall surface 231*a* on the Z-direction side and a wall surface 232*a* on the Z'-direction side. The insertion holes 230*b* of the body 200 are rectangular holes on the Y-direction side with respect to the accommodation holes 210*b* of the body 200 so as to communicate with the respective accommodation hole 210*b*. The insertion holes 230*b* are open in the Y direction. As shown in FIG. 2B, each insertion hole 230*b* is smaller in cross-sectional shape in the Z-Z' direction than each accommodation hole 210*b*. Each insertion hole 230*b* includes a wall surface 231*b* on the Z-direction side and a wall surface 232*b* on the Z'-direction side.

The engaging grooves 240*a* of the body 200 are provided on the X-direction side with respect to the first portions 211*a* of the accommodation holes 210*a* of the body 200 so as to communicate with the respective first portions 211*a*. The engaging grooves 240*b* of the body 200 are provided on the X'-direction side with respect to the first portions 211*b* of the accommodation holes 210*b* of the body 200 so as to communicate with the respective first portions 211*b*.

The slit 250 is provided between the Z-direction portion of the body 200 and the Z'-direction portion of the body 200. The Z-direction portion is a portion of the body 200 provided with the accommodation holes 210*a* and 210*b* on the Z-direction side and the cable accommodation holes 220*a* and 220*b* on the Z-direction side. The Z'-direction portion is a portion of the body 200 provided with the accommodation holes 210*a* and 210*b* on the Z'-direction side and the cable accommodation holes 220*a* and 220*b* on the Z'-direction side. The slit 250 is open in the Y' direction. Also open are the Y'-direction portions of X-X' direction opposite ends of the slit 250.

As shown in FIGS. 2A to 4B, the terminals 100*a* are made of metal plates. The terminals 100*a* each include a first fixable portion 110*a*, a second fixable portion 120*a*, a joining portion 130*a*, a first contacting portion 140*a*, a second contacting portion 150*a*, a connectable portion 160*a*, and a holding portion 170*a*.

Figure 4A:
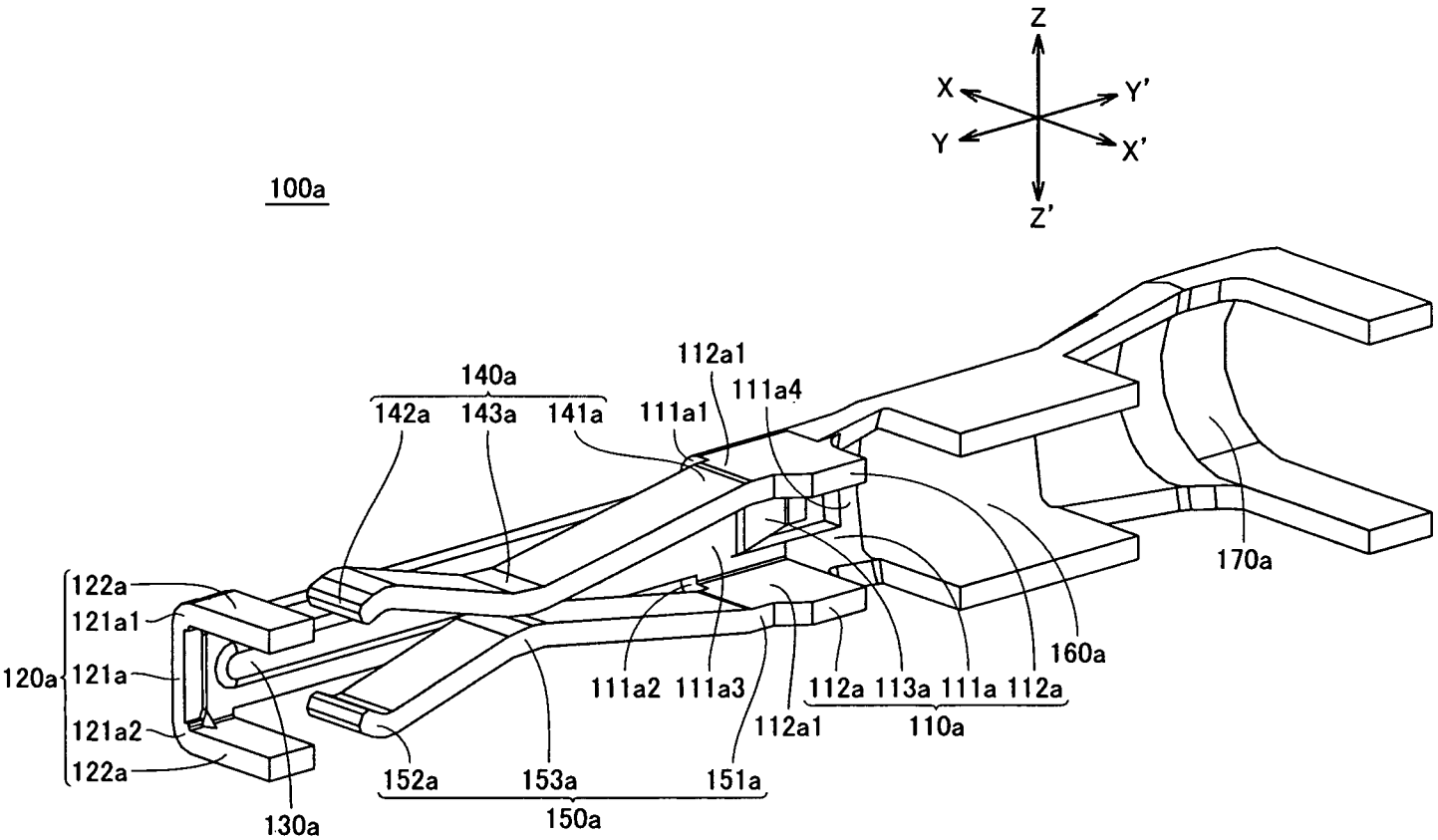
FIG. 4A is a front, top, right side perspective view of the terminal according to Embodiment 1 of the invention.
Figure 4B:
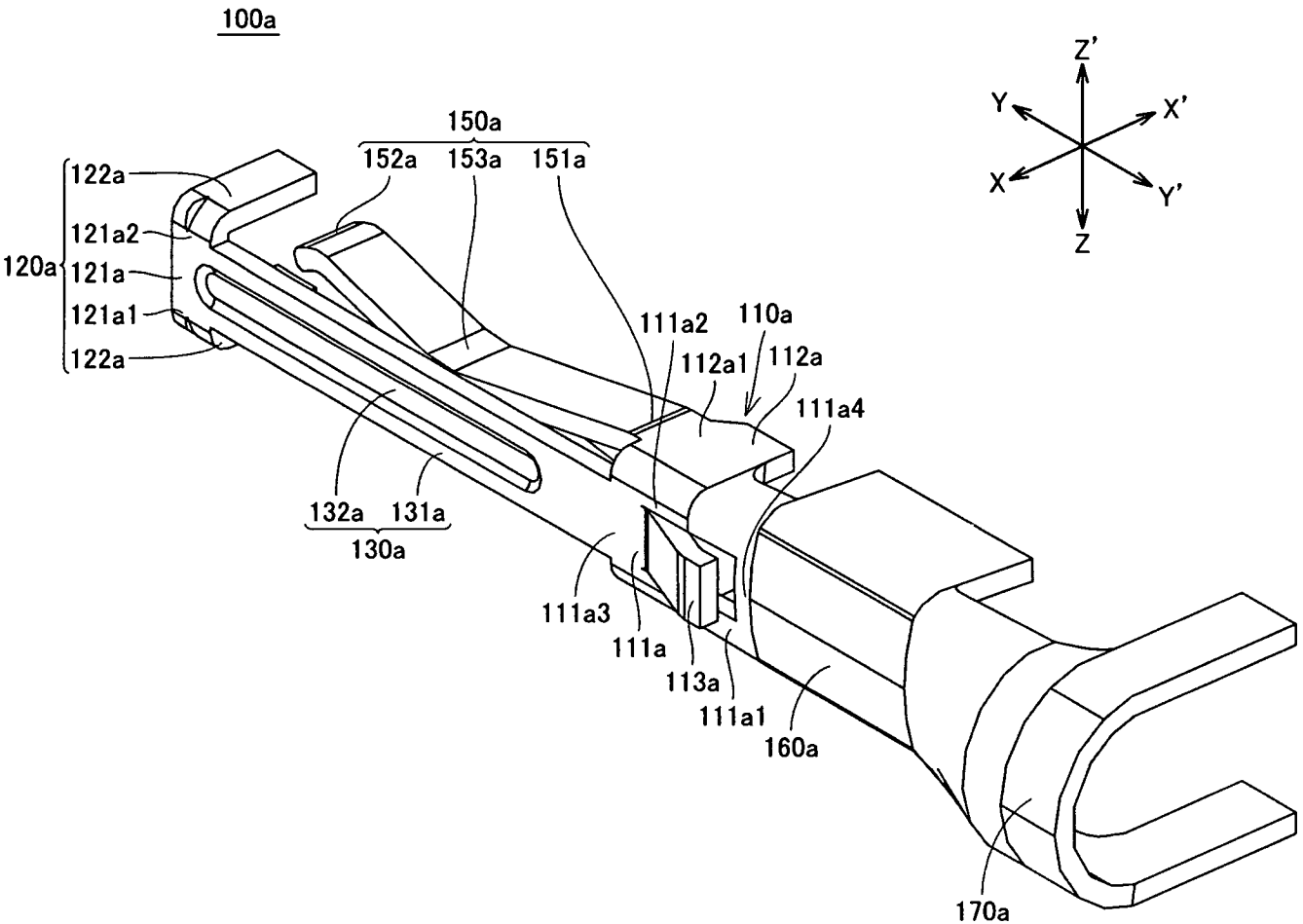
FIG. 4B is a rear, bottom, left side perspective view of the terminal.

As best shown in FIGS. 4A and 4B, each first fixable portion 110*a* is a metal plate of generally C-shaped cross section. The first fixable portion 110*a* includes a base 111*a*, first and second projections 112*a*, and an engaging piece 113*a*. The base 111*a* is a generally rectangular metal plate. The base 111*a* includes a first end 111*a*1 in the Z direction, a second end 111*a*2 in the Z' direction, a third end 111*a*3 in the Y direction, and a fourth end 111*a*4 in the Y' direction. The engaging piece 113*a* is a central portion of the base 111*a* that is cut and bent with respect to the base 111*a* so as to be inclined in the X and Y' directions. The first and second projections 112*a* are metal plates extending in the X' direction. The first projection 112*a* is provided at the first end 111*a*1 of the base 111*a* and has an end 112*a*1 in the Y direction. The second projection 112*a* is provided at the second end 111*a*2 of the base 111*a* and has an end 112*a*1 in the Y direction.

The first fixable portions 110*a* can be fixed to the first portions 211*a* of the accommodation holes 210*a* of the body 200, and each has a dimension in the Z-Z' direction and a dimension in the X-X' direction. Specifically, as shown in FIG. 2A, the D1 is the distance in the Z-Z' direction between the outer faces (the upper and lower faces as shown in FIG. 2A) of the first and second projections 112*a*. The D1 is substantially the same as or slightly smaller than the Z-Z' direction dimension of the first portion 211*a* of the associated accommodation hole 210*a*. Accordingly, the outer face of the first projection 112*a* abuts the wall surface 211*a*1 on the Z-direction side of the first portion 211*a*, and the outer face of the second projection 112*a* abuts the wall surface 211*a*2 on the Z'-direction side of the first portion 211*a*. As shown in FIG. 2B, the D2 is the sum of the X-X' direction dimension of the base 111*a* and the X-X' direction dimension of each projection 112*a*. The D2 is substantially the same as or slightly smaller than the X-X' direction dimension of the first portion 211*a* of the associated accommodation hole 210*a*. Accordingly, the base 111*a* abuts the wall surface 211*a*3 on the X-direction side of the first portion 211*a*, and the end faces in the X' direction of the first and second projections 112*a* abut the wall surface 211*a*4 on the X'-direction side of the first portion 211*a*. The engaging piece 13*a* is engaged with the engaging groove 240*a*.

As best shown in FIGS. 4A and 4B, each second fixable portion 120*a* is a metal plate of generally C-shaped cross section. The second fixable portion 120*a* is spaced from the first fixable portion 110*a* in the Y-Y' direction. The second fixable portion 120*a* includes a base 121*a* and first and second projections 122*a*. The base 121*a* is a generally rectangular metal plate. The base 121*a* includes a first end 121*a*1 in the Z direction and a second end 121*a*2 in the Z' direction. The two projections 122*a* are metal plates extending in the X' direction. The first projection 122*a* is provided at the first end 121*a*1 of the base 121*a*, and the second projection 122*a* is provided at the second end 121*a*2 of the base 121*a*.

The second fixable portion 120*a* can be fixed to the second portions 212*a* of the accommodation holes 210*a* of the body 200, and each has a dimension in the Z-Z' direction and a dimension in the X-X' direction. Specifically, as shown in FIG. 2A, the D3 is the distance in the Z-Z' direction between the outer faces (the upper and lower faces as shown in FIG. 2A) of the first and second projections 122*a*. The D3 is substantially the same as or slightly smaller than the Z-Z' direction dimension of the second portion 212*a* of the associated accommodation hole 210*a*. Accordingly, the outer face of the first projection 122*a* abuts the wall surface 212*a*1 on the Z-direction side of the second portion 212*a*, and the outer face of the second projection 122*a* abuts the wall surface 212*a*2 on the Z'-direction side. As shown in FIG. 2B, the D4 is the sum of the X-X' direction dimension of the base 121*a* and the X-X' direction dimension of each projection 122*a*. The D4 is substantially the same as or slightly smaller than the X-X' direction dimension of the second portion 212*a* of the associated accommodation hole 210*a*. Accordingly, the base 121*a* abuts the wall surface 212*a*3 on the X-direction side of the second portion 212*a*, and the end faces in the X' direction of the first and second projections 122*a* abut the wall surface 212*a*4 on the X'-direction side of the second portion 212*a*. It should be noted that the dimension D3 is the same as the dimension D1, and that the dimension D4 is the same as the dimension D2.

Each joining portions 130*a* is a metal plate extending in the Y-Y' direction from the third end 111*a*3 of the first fixable portion 110*a* toward the second fixable portion 120*a*. In other words, the joining portion 130*a* joins the first fixable portion 110*a* and the second fixable portion 120*a*. Each joining portion 130*a* is larger in Y-Y' direction dimension than each of the first and second contacting portions 140*a* and 150*a*. Accordingly, the second fixable portion 120*a* is located on the Y-direction side with respect to the first and second contacting portions 140*a* and 150*a*. The joining portions 130*a* are accommodated in the respective third portions 213*a* of the accommodation holes 210*a* of the body 200. As best shown in FIG. 4B, the joining portions 130*a* each include an abutting face 131*a* and a recess 132*a*. As best shown in FIG. 2B, the abutting face 131*a* abuts the wall surface 213*a*3 on the X-direction side of the third portion 213*a* of the associated accommodation hole 210*a*. The recess 132*a* is an elongated groove in the abutting face 131*a*, extending in the Y-Y' direction. The recess 132*a* serves to reduce the area of the abutting face 131*a* to contact the wall surface 213*a*3. The joining portion 130*a* is smaller in Z-Z' direction dimension than each of the first and second fixable portions 110*a* and 120*a* (D1 and D3). Accordingly, as shown in FIG. 2A, the joining portion 130*a* will not be brought into contact with the wall surface 213*a*1 on the Z-direction side of the third portion 213*a* and the wall surface 213*a*2 on the Z'-direction side of the third portion 213*a*.

Each first contacting portion 140*a* is a generally V-shaped metal plate extending in the Y direction (to the side of the second fixable portion 120*a*) from the end 112*a*1 of the first projection 112*a* of the first fixable portion 110*a*. The first contacting portions 140*a* are accommodated in the third portion 213*a* of the associated accommodation holes 210*a* of the body 200. The first contacting portions 140*a* each include a fixed end 141*a*, a free end 142*a*, and a contactable portion 143*a*. The fixed end 141*a* is the Y'-direction end of the first contacting portion 140*a* and is integral with (fixed to) the end 112*a*1 of the first projection 112*a*. The free end 142*a* is Y-direction end of the first contacting portion 140*a* (the end opposite the fixed end 141*a*). The contactable portion 143*a* is provided between the fixed end 141*a* and the free end 142*a* of the first contacting portion 140*a*. The contactable portion 143*a* is bent to form an angle whose vertex is located on the Z'-direction side with respect to the fixed end 141*a* and the free end 142*a*. The distance L1 in the Y-Y' direction from the fixed end 141*a* to the vertex of the contactable portion 143*a* is larger than the distance L2 in the Y-Y' direction from the free end 142*a* to the vertex of the contactable portion 143*a*.

Figure 5:
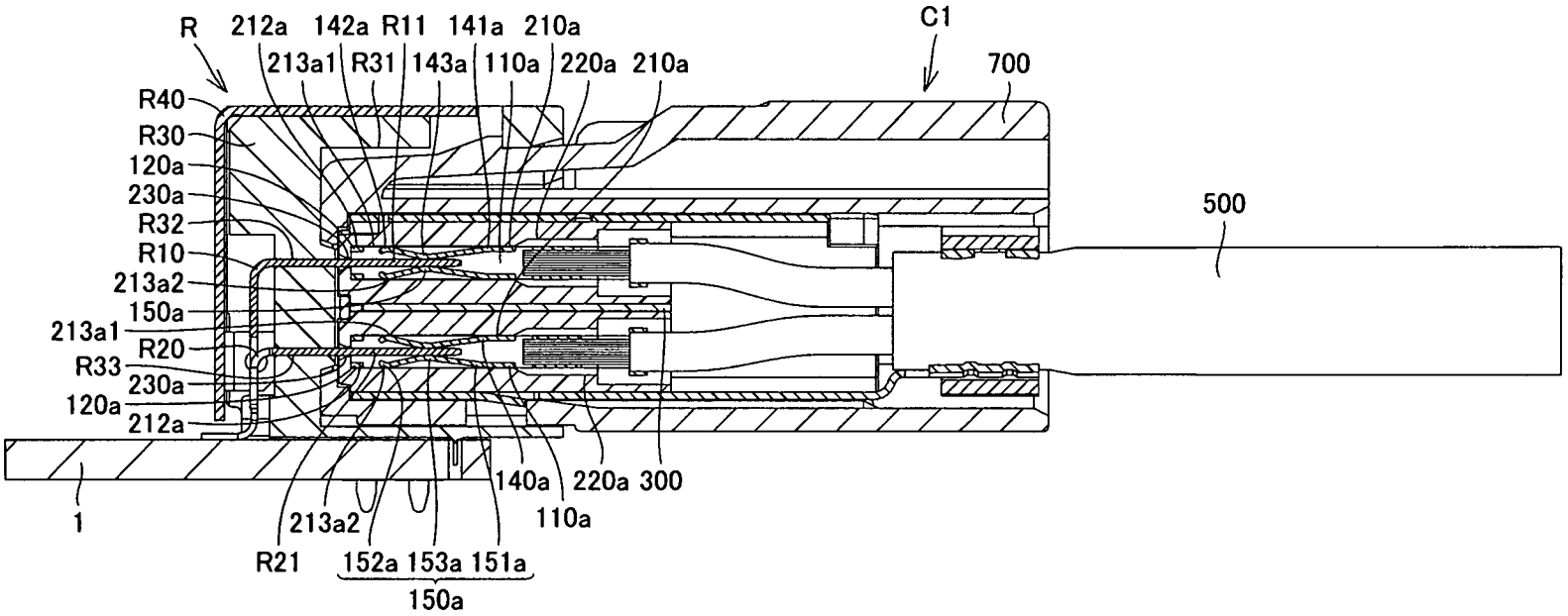
FIG. 5 is a cross-sectional view showing the connector as connected with a mating connector.

The relative positioning of the free end 142*a* and the wall surface 213*a*1 on the Z-direction side of the third portion 213*a* of the accommodation hole 210*a* is such that (a) when the first contacting portion 140*a* is located in the neutral position as shown in FIG. 2A, there is a clearance between the free end 142*a* and the wall surface 213*a*1 in the Z-Z' direction, and that (b) when the first contacting portion 140*a* resiliently deforms from the neutral position to the Z-direction side as shown in FIG. 5, the free end 142*a* abuts the wall surface 213*a*1. Also, the free end 142*a* is located on the Z-direction side with respect to the wall surface 231*a* on the Z-direction side of the insertion hole 230*a* of the body 200. In other words, the wall surface 231*a* is located on the Z'-direction side with respect to the free end 142*a*.

Each second contacting portion 150*a* is a metal plate extending in the Y direction (to the side of the second fixable portion 120*a*) from the end 12*a*1 of the second projection 12*a* of the first fixable portion 110*a*. The second contacting portion 150*a* and the first contacting portion 140*a* have symmetric shapes in the Z-Z' direction. The second contacting portion 150*a* includes a fixed end 151*a*, a free end 152*a*, and a contactable portion 153*a*. The fixed end 151*a* is the Y'-direction end of the second contacting portion 150*a* and is integral with (fixed to) the end 112*a*1 of the second projection 112*a*. The free end 152*a* is the Y-direction end of the second contacting portion 150*a* (the end opposite the fixed end 151*a*). The contactable portion 153*a* is provided between the fixed end 151*a* and the free end 152*a* of the second contacting portion 150*a*. The contactable portion 153*a* is bent to form an angle whose vertex is located on the Z-direction side with respect to the fixed end 151*a* and the free end 152*a*. It is appreciated that the contactable portions 143*a* and 153*a* are bent in directions closer to each other. The distance L3 in the Y-Y' direction from the fixed end 151*a* to the vertex of the contactable portion 153*a* is larger than the distance L4 in the Y-Y' direction from the free end 152*a* to the vertex of the contactable portion 153*a*. It should be noted that the distance L3 is the same as the L1, and that the distance L4 is the same as the L2.

The relative positioning of the free end 152*a* and the wall surface 213*a*2 on the Z'-direction side of the third portion 213*a* of the accommodation hole 210*a* is such that (a) when the second contacting portion 150*a* is located in an neutral position as shown in FIG. 2A, there is a clearance between the free end 152*a* and the wall surface 213*a*2 in the Z-Z' direction, and that (b) when the second contacting portion 150*a* resiliently deforms from the neutral position to the Z'-direction side as shown in FIG. 5, the free end 152*a* abuts the wall surface 213*a*2. Also, the free end 152*a* is located on the Z'-direction side with respect to the wall surface 232*a* on the Z'-direction side of the insertion hole 230*a* of the body 200. In other words, the wall surface 232*a* is located on the Z-direction side with respect to the free end 152*a*.

Each connectable portion 160*a* is a metal plate contiguous with the fourth end 111*a*4 of the first fixable portion 110*a* so as to be located on the Y'-direction side with respect to the first fixable portion 110*a*. The connectable portion 160*a* is bent such as to have a generally C-shaped cross section adapted to hold a core wire 521 of a signal line 520 of the cable 500. The terminal 100*a* is thus electrically connected to the signal line 520 of the cable 500. It should be noted that FIGS. 4A and 4B illustrates the connectable portion 160*a* in a state before holding the core wire 521 of the cable 500.

Each holding portion 170*a* is a metal plate contiguous with the connectable portion 160*a* so as to be located on the Y'-direction side of the connectable portion 160*a*. The holding portion 170*a* bent such as to have a generally C-shaped cross section adapted to hold an insulator 522 of the signal line 520 of the cable 500. It should be noted that FIGS. 4A and 4B illustrates the holding portion 170*a* in a state before holding the insulator 522.

The terminals 100*b* are of the same configuration as the terminals 100*a*. The terminals 100*b* are accommodated in the respective accommodation holes 210*b*, in the reversed geometry in the X-X' direction to the terminals 100*a*. Like the first and second fixable portions 11*a* and 120*a* of the terminals 100*a*, first and second fixable portions 110*b* and 120*b* of the terminals 100*b* are fixed to the respective first and second portions 211*b* and 212*b* of the accommodation holes 210*b* of the body 200. Like the joining portions 130*a* of the terminals 100*a*, the joining portions 130*b* of the terminals 100*b* are accommodated in the respective third portions 213*b* of the accommodation holes 210*b*. Like the first and second contacting portions 140*a* and 150*a* of the terminals 100*a*, first and second contacting portions 140*b* and 150*b* of the terminal 100*b* are accommodated in the respective third portions 213*b* of the accommodation holes 210*b*. Connectable portion 160*b* of the terminals 100*b* holds the respective core wires 521 of the signal lines 520 of the cable 500, and they are accommodated in the cable accommodation holes 220*b* of the body 200. Holding portions 170*b* of the terminals 100*b* hold the respective insulators 522 of the signal lines 520 of the cable 500, and they are accommodated in the respective cable accommodation holes 220*b* of the body 200.

The cable 500 has a tuboid outer insulator 510, a plurality of signal lines 520, and an external conductor (not shown). The external conductor is a copper braided tube extending concentrically inside the outer insulator 510. The signal lines 520 are arranged inside the external conductor. The signal lines 520 each include a core wire 521 and an insulator 522 covering the core wire 521. At a lengthwise end of the cable 500, a lengthwise end (hereinafter referred to as the projected portion) of the external conductor projects from the outer insulator 510, a lengthwise end (hereinafter referred to as the projected portion) of each signal line 520 projects from the projection of the external conductor, and a lengthwise end (hereinafter referred to as the projected portion) of each core wire 521 projects from the insulator 522 of the signal line 520.

The shield plate 300 is a metal plate as shown in FIGS. 3A and 3B. The shield plate 300 is inserted in the slit 250 of the body 200. The shield plate 300 extends between the terminals 100*a* and 100*b* on the Z-direction side and the terminals 100*a* and 100*b* on the Z'-direction side. A pair of connecting arms 310 are provided at the respective ends in the X-X' direction of the shield plate 300. One of the connecting arms 310 diagonally extends in the X and Y' directions to project from the slit 250 in the X direction. The other connecting arm 310 diagonally extends in the X' and Y' directions to project from the slit 250 in the X' direction.

The shield case 400 is a metal plate as shown in FIGS. 3A and 3B. The shield case 400 includes a first shell 410, a second shell 420, and a ring-shaped holding portion 430. The first and second shells 410 and 420 are square tuboid metal plates spaced from each other in the Y-Y' direction. The plates in the Z' direction of the first and second shells 410 and 420 are connected to each other. Engaging pieces 411 are provided each on the plate in the X direction, the plate in the X' direction, and the plate in the Z' direction of the first shell 410. The first shell 410 has an inner shape conforming to the outer shape of the body 200. The first and second shells 410 and 420 accommodate the body 200 with the terminals 100*a* and 100*b* and the shield plate 300 attached thereto. The second shell 420 also accommodates the projected portions of the signal lines 520 as connected to the terminals 100*a* and 100*b*. The inner faces in the X-X' direction of the second shell 420 are in contact with the connecting arms 310 of the shield plate 300 as received in the slit 250 of the body 200. The shield case 400 is thereby connected to the shield plate 300 electrically.

The holding portion 430 is connected to the second shell 420 so as to be located on the Y'-direction side with respect to the second shell 420. The holding portion 430 fittingly receives the projected portion of the external conductor of the cable 500. The shield case 400 is thereby connected to the external conductor of the cable 500 electrically.

The ring 600 fittingly receives the holding portion 430 as fittingly receiving the external conductor of the cable 500. The ring 600 serves to maintain the state where the holding portion 430 fittingly receives the external conductor of the cable 500.

The case 700 is made of an insulation resin. The case 700 includes an accommodation hole 710, first and second openings 720 and 730, and three engaging holes 740. The accommodation holes 710 are square holes in the case 700, extending in the Y-Y' direction. The accommodation hole 710 is of shape conforming to the combined outer shape of the first and second shells 410 and 420 of the shield case 400. The accommodation hole 710 accommodates the terminals 100*a* and 100*b*, the body 200, the shield case 400, the ring 600, and the lengthwise end of the cable 500. The first opening 720 is provided on the Y-direction side with respect to the accommodation hole 710 of the case 700 such as to expose the insertion holes 230*a* and 230*b* on the Z-direction side of the body 200. The second opening 730 is provided on the Y-direction side with respect to the accommodation hole 710 of the case 700 such as to expose the insertion holes 230*a* and 230*b* on the Z'-direction side of the body 200. The portion between the first and second openings 720 and 730 of the case 700 abuts the body 200.

The engaging holes 740 of the case 700 are provided in portions on the X-direction side, on the X'-direction side, and on the Z'-direction side, respectively, with respect to the accommodation hole 710 so as to communicate with the accommodation hole 710. The engaging holes 740 are engaged with the respective engaging pieces 411 of the accommodated shield case 400.

The connector C1 configured as described above may be assembled in the following steps. First, the body 200 and the shield plate 300 are prepared. The shield plate 300 is inserted into the slit 250 of the body 200. The inserted shield plate 300 is positioned such that one of the connecting arms 310 projects from the slit 250 in the X direction, and the other connecting arm 310 projects from the slit 250 in the X' direction.

The terminals 100*a* and 100*b* and the cable 500 are also prepared. The projected portions of the core wires 521 of the signal lines 520 of the cable 500 are fixed to the connectable portions 160*a* and 160*b* of the terminals 100*a* and 100*b* by press-fitting or soldering. The insulators 522 of the signal lines 520 are held by the holding portions 170*a* and 170*b* of the terminals 100*a* and 100*b*. The terminals 100*a* are then inserted through the cable accommodation holes 220*a* of the body 200 into the accommodation holes 210*a*. Simultaneously, the second fixable portions 120*a* of the terminals 100*a* are slid on and along the wall surfaces of the accommodation holes 210*a* (the wall surfaces 211*a*1 to 211*a*4 of the first portions 211*a*, the wall surfaces 213*a*1 to 213*a*4 of the third portions 213*a*, and the wall surfaces 212*a*1 to 212*a*4 of the second portions 212*a*), and then the second fixable portions 120*a* are accommodated in the accommodation holes 210*a*. Also, the first fixable portions 110*a* are slid on and along the wall surfaces of the accommodation holes 210*a* (the wall surfaces 211*a*1 to 211*a*4 of the first portions 211*a*), and then the first fixable portions 110*a* are accommodated in the accommodation holes 210*a*. The abutting faces 131*a* of the joining portions 130*a* are slid on and along the wall surfaces 211*a*3 on the X-direction side of the first portions 211*a* of the accommodation holes 210*a* and the wall surfaces 213*a*3 on the X-direction side of the third portions 213*a* of the accommodation holes 210*a*, and then the joining portions 130*a* are accommodated in the accommodation holes 210*a*. When accommodating the joining portions 130*a*, they are not in contact with the accommodation holes 210*a* in the Z-Z' and X' directions. The first and second contacting portions 140*a* and 150*a* are accommodated in the accommodation holes 210*a* together with the joining portions 130*a*, without contacting any wall surfaces of the accommodation holes 210*a* in the Z-Z' and X-X' directions. Into the cable accommodation holes 220*a* of the body 200 accommodated are the connectable portions 160*a* and the holding portions 170*a* of the terminals 100*a* and the projected portions of the signal lines 520 of the cable 500 as held by the connectable portions 160*a* and the holding portions 170*a*.

When the second fixable portions 120*a*, the joining portions 130*a*, the first and second contacting portions 140*a* and 150*a*, and the first fixable portion 110*a* of the terminals 100*a* are accommodated in the accommodation hole 210*a* such that the subelements of each terminal 100 are arranged as follows: The outer face of the first projection 122*a* of the second fixable portion 120*a* abuts the wall surface 212*a*1 on the Z-direction side of the associated second portion 212*a*, and the outer face of the second projection 122*a* abuts the wall surface 212*a*2 on the Z'-direction side of the second portion 212*a*. Also, the base 121*a* of the second fixable portion 120*a* abuts the wall surface 212*a*3 on the X-direction side of the second portion 212*a*, and the end faces in the X' direction of the first and second projections 122*a* abut the wall surface 212*a*4 on the X'-direction side of the second portion 212*a*. The second fixable portion 120*a* is thus fixed to the second portion 212*a* of the associated accommodation hole 210*a* to be in position with respect to the Z-Z' and X-X' directions. Also, the abutting face 131*a* of the joining portion 130*a* abuts the wall surface 213*a*3 on the X-direction side of the third portion 213*a* of the associated accommodation hole 210*a*. The outer face of the first projection 112*a* of the first fixable portion 110*a* abuts the wall surface 211*a*1 on the Z-direction side of the associated first portion 211*a*, and the outer face of the second projection 112*a* abuts the wall surface 211*a*2 on the Z'-direction side of the first portion 211*a*. The base 111*a* of the first fixable portion 110*a* abuts the wall surface 211*a*3 on the X-direction side of the first portion 211*a*, and the end faces in the X' direction of the first and second projections 112*a* abut the wall surface 211*a*4 on the X'-direction side of the first portion 211*a*. The first fixable portion 110*a* is thus fixed to the first portion 211*a* of the associated accommodation hole 210*a* to be in position with respect to the Z-Z' and X-X' directions. The engaging piece 113*a* is engaged with the associated engaging groove 240*a* of the body 200. The free end 142*a* of the first contacting portion 140*a* is positioned in spaced relation to the wall surface 213*a*1 of the associated accommodation hole 210*a* and on the Z-direction side with respect to the wall surface 231*a* of the associated insertion hole 230*a* of the body 200. The free end 152*a* of the second contacting portion 150*a* is positioned in spaced relation to the wall surface 213*a*2 of the associated accommodation hole 210*a* and on the Z'-direction side with respect to the wall surface 232*a* of the associated insertion hole 230*a* of the body 200.

In a similar manner to the terminals 100*a*, the terminal 100*b* are inserted through the cable accommodation holes 220*b* to be accommodated into the accommodation holes 210*b* of the body 200. As a result, the second fixable portions 120*b* are fixed to the second portion 212*b* of the accommodation hole 210*b* to be in position with respect to the Z-Z' and X-X' directions. The first fixable portions 110*b* are fixed to the first portions 211*b* of the accommodation holes 210*b* to be in position with respect to the Z-Z' and X-X' directions. The joining portions 130*b* and the first and second contacting portions 140*b* and 150*b* are accommodated in the third portions 213*b* of the accommodation holes 210*b*. The engaging pieces 113*b* are brought into engagement with the engaging grooves 240*b* of the body 200. Into the cable accommodation holes 220*b* of the body 200 accommodated are the connectable portions 160*b* and the holding portions 170*b* of the terminals 100*b* and the projected portions of the signal lines 520 of the cable 500 as held by the connectable portions 160*b* and the holding portions 170*b*.

The shield case 400 is also prepared. The body 200 is inserted into the second and first shells 420 and 410 of the shield case 400. When the body 200 is fitted into the second and first shells 420 and 410, the pair of connecting arms 310 of the shield plate 300 as attached to the body 200 are brought into contact with the opposed inner faces in the X-X' direction of the second shell 420. Also, the portions of the signal lines 520 of the cable 500 projecting from the cable accommodation holes 220*a* and 220*b* are inserted into the second shell 420. After that, the holding portion 430 of the shield case 400 is made to hold the portion of the external conductor projecting from the outer insulator 510 of the cable 500. As a result, the shield case 400 and the shield plate 300 are electrically connected to the external conductor of the cable 500.

The case 700 is also prepared. Into the accommodation hole 710 of the case 700 fitted are the first and second shells 410 and 420 of the shield case 400, and the holding portion 430 is also accommodated into the accommodation hole 710. The case 700 thus accommodates the terminals 100*a* and 100*b*, the body 200, the shield plate 300, the shield case 400, and the lengthwise ends of the cable 500. The connector C1 is now assembled.

The assembled connector C1 is connectable to a mating connector R as shown in FIG. 5. The mating connector R is a receptacle connector mounted on a substrate 1. The mating connector R includes two terminals R10 (one of them is shown), two terminals R20 (one of them is shown), a body R30 made of an insulation resin, and a shell R40. The body R30 is provided with a connection hole R31 for connection with the connector C1. The body R30 also includes two holding holes R32 (one of them is shown) on the Z-direction side, and two holding holes R33 (one of them is shown) on the Z'-direction side. These four holding holes communicate with the connection hole R31. The terminals R10, metals plate of L-shaped cross section, are partly held by the respective holding holes R32 of the body R30 and connected to the substrate 1. Each terminal R10 includes a pin R11 projecting from the associated holding hole R32 into the connection hole R31. The terminals R20, metals plate of L-shaped cross section, are partly held by the respective holding holes R33 of the body R30 and connected to the substrate 1. Each terminal R20 includes a pin R21 projecting from the associated holding hole R33 into the connection hole R31. The shell R40 covers the body R30.

When the connector C1 is fitted into the connection hole R31 of the mating connector R, the pins R11 of the terminals R10 are inserted through the associated insertion holes 230*a* and 230*b* on the Z-direction side of the body 200 into the associated accommodation holes 210*a* and 210*b* on the Z-direction side. The pins R21 of the terminals R20 are inserted through the associated insertion holes 230*a* and 230*b* on the Z'-direction side of the body 200 into the associated accommodation holes 210*a* and 210*b* on the Z'-direction side. With regard to the terminal R10 on the X-direction side, the inserted pin R11 is placed between the first contacting portion 140*a* and the second contacting portion 150*a* of the associated terminal 100*a* on the Z-direction side, so that the contactable portions 143*a* and 153*a* of the first and second contacting portions 140*a* and 150*a* are pressed by the pin R11 (placed under a load). As a result, the first and second contacting portions 140*a* and 150*a* resiliently deform in directions away from each other. Specifically, the first contacting portion 140*a* resiliently deforms from the neutral position in the Z direction, the free end 142*a* is brought into abutment with the wall surface 213*a*1 on the Z-direction side of the associated accommodation hole 210*a*, and the first contacting portion 140*a* is supported at two places, i.e. on the free end 142*a* and the first projection 112*a* of the first fixable portion 110*a*. The second contacting portion 150*a* resiliently deforms from the neutral position in the Z' direction, the free end 152*a* is brought into abutment with the wall surface 213*a*2 on the Z'-direction side of the associated accommodation hole 210*a*, and the second contacting portion 150*a* is supported at two places, i.e. on the free end 152*a* and the second projection 112*a* of the first fixable portion 110*a*. The pin R11 is thus held with a large contact pressure between the contactable portions 143*a* and 153*a* of the first and second contacting portions 140*a* and 150*a*. The terminal 100*a* on the Z-direction side and the terminal R10 on the X-direction side are thus connected. Likewise, the terminal R10 on the X'-direction side is connected to the terminal 100*b* on the Z-direction side. The terminals R20 are also connected to the associated terminals 100*a* and 100*b* on the Z'-direction side in a similar manner to the terminals R10.

The connector C1 as described above has at least the following technical characteristics. First, when the connector C1 is connected to the mating connector R, the terminals 100*a* and 100*b* are unlikely to be decentered in the Z-Z' direction due to pressures of the terminals R10 and R20 on the first and second contacting portions 140*a* and 150*a* of the terminals 100*a* and on the first and second contacting portions 140*b* and 150*b* of the terminals 100*b*. The reasons for this are as follows. The first fixable portions 110*a* of the terminals 100*a* are fixed to the Z-Z' and X-X' directions by the first portions 211*a* of the accommodation holes 210*a* of the body 200, and the second fixable portions 120*a* are fixed to the Z-Z' and X-X' directions, on the Y-direction side with respect to the first and second contacting portions 140*a* and 150*a*, by the second portions 212*a* of the accommodation holes 210*a* of the body 200. In addition, the first fixable portions 110*b* of the terminals 100*b* are fixed to the Z-Z' and X-X' directions by the first portions 211*b* of the accommodation holes 210*b* of the body 200, and the second fixable portion 120*b* are fixed to the Z-Z' and X-X' directions, on the Y-direction side with respect to the first and second contacting portions 140*b* and 150*b*, by the second portion 212*b* of the accommodation hole 210*b* of the body 200.

Second, the terminals 100*a* can be easily accommodated in the accommodation holes 210*a* of the body 200 for the following reasons. The joining portions 130*a* of the terminals 100*a* are smaller in Z-Z' direction dimension than the first and second fixable portions 110*a* and 120*a*. Accordingly, when the terminals 100*a* are inserted into the accommodation holes 210*a* of the body 200, the abutting faces 131*a* of the joining portions 130*a* slide on and along the wall surfaces 211*a*3 and 213*a*3 on the X-direction side of the accommodation holes 210*a*, but the joining portions 130*a* do not slide on the wall surfaces 211*a*1 and 213*a*1 on the Z-direction side of the accommodation holes 210*a* or on the wall surfaces 211*a*2 and 213*a*2 on the Z'-direction side of the accommodation holes 210*a*. In addition, the abutting face 131*a* with the recesses 132*a* have reduced contact areas in contact with the wall surfaces 211*a*3 and 213*a*3. For similar reasons to those for the terminal 100*a*, the terminals 100*b* can be easily accommodated in the accommodation holes 210*b* of the body 200.

Third, the connector C1 is configured such as to reduce the possibility of buckling the first and second contacting portions 140*a* and 150*a* of the terminals 100*a* due to pressure on the portions 140*a* and 150*a* applied by the terminals R10 and R20 inserted through the insertion holes 230*a* of the body 200 into the accommodation holes 210*a*. The reasons for this are as follows. The wall surfaces 231*a* on the Z-direction side of the insertion holes 230*a* of the body 200 are arranged on the Z'-direction side with respect to the free ends 142*a* of the first contacting portions 140*a*, and the wall surfaces 232*a* on the Z'-direction side of the insertion hole 230*a* of the body 200 are arranged on the Z-direction side with respect to the free ends 152*a* of the second contacting portions 150*a*. Accordingly, it is possible to prevent the terminals R10 and R20 inserted into the insertion holes 230*a* from colliding with the free ends 142*a* and 152*a* of the first and second contacting portions 140*a* and 150*a*. In other words, the connector C1 is configured such as to prevent the first and second contacting portions 140*a* and 150*a* from buckling due to collision of the terminals R10 and R20 with the free ends 142*a* and 152*a* of the first and second contacting portions 140*a* and 150*a*. The connector C1 is configured such as to also prevent the first and second contacting portions 140*b* and 150*b* of the terminal 100*b* from buckling for the similar reasons to those for the terminals 100*a*.

Fourth, the connector C1 is configured such as to allow insertion of the terminals R10 and R20 at light load between the first contacting portions 140*a* and the second contacting portions 150*a* of the terminals 100*a*, while the inserted terminals R10 and R20 can held between the first and second contacting portions 140*a* and 150*a* with increased contact pressures. The reasons for this are as follows. In the neutral positions, the free ends 142*a* and 152*a* of the first and second contacting portions 140*a* and 150*a* are in spaced relation to the wall surfaces 213*a*1 and 213*a*2 of the accommodation holes 210*a*. Accordingly, when the terminals R10 and R20 are inserted between the first contacting portions 140*a* and the second contacting portions 150*a* of the terminals 100*a*, the first and second contacting portions 140*a* and 150*a* can resiliently deform at light load in the directions away from each other. Once the first and second contacting portions 140*a* and 150*a* have deformed, the free ends 142*a* and 152*a* of the first and second contacting portions 140*a* and 150*a* are brought into abutment with the wall surfaces 213*a*1 and 213*a*2. That is, the first and second contacting portions 140*a* and 150*a* are each supported at two places, i.e. on the free ends 142*a* and 152*a* and the first fixable portion 110*a*, so that the first and second contacting portions 140*a* and 150*a* can hold therebetween the terminals R10 and R2 with an increased contact pressure. Likewise, the terminals R10 and R20 can be inserted at light load between the first contacting portions 140*b* and the second contacting portions 150*b* of the terminals 100*b*, while the inserted terminals R10 and R20 can held between the first and second contacting portions 140*b* and 150*b* with increased contact pressures.

Fifth, the first and second contacting portions 140*a* and 150*a* provide optimum contact pressures on the inserted terminals R10 and R20. The is because each terminal 100*a* is configured such that the distance L1 in the Y-Y' direction from the fixed end 141*a* to the vertex of the contactable portion 143*a* is larger than the distance L2 in the Y-Y' direction from the free end 142*a* to the vertex of contactable portion 143*a*, and the distance L3 in the Y-Y' direction from the fixed end 151*a* to the vertex of the contactable portion 153*a* is larger than the distance L4 in the Y-Y' direction from the free end 152*a* to the vertex of the contactable portion 153*a*. As required by demand on optimum contact pressures of the terminals 100*a*, the distances L1 and L2 can be changed to provide optimum contact pressures of the first contacting portions 140*a* on the inserted terminals R10 and R20, and the distances L3 and L4 can be changed d to provide optimum contact pressure of the second contacting portions 150*a* on the inserted terminals R10 and R20. The same hold true for the first and second contacting portions 140*b* and 150*b* of the terminals 100*b*.

Embodiment 2

Figure 6:
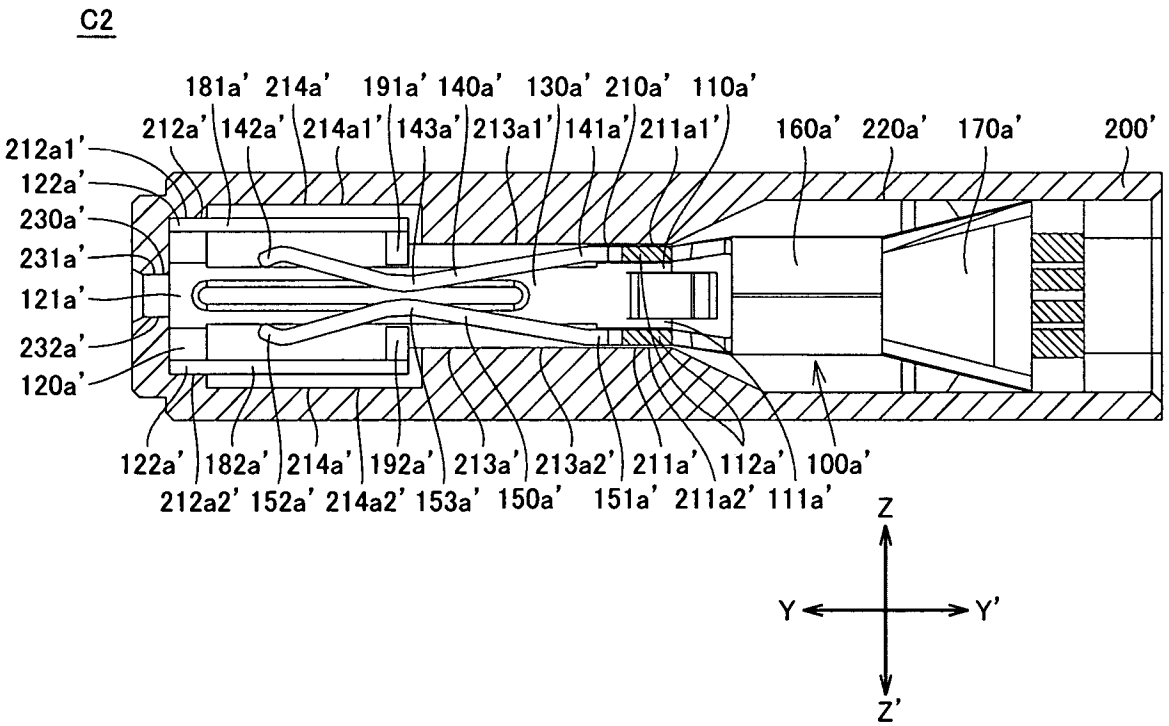
FIG. 6 is a cross-sectional view of a body and a terminal of a connector according to Embodiment 2 of the invention.

A connector C2 according to Embodiment 2 of the invention will be described below with reference to FIG. 6. The connector C2 as shown in FIG. 6 includes a terminal 100*a*', a body 200', and a cable (not shown). These constituents of the connector C2 will be described below in detail. It should be noted that, the Y-Y' direction shown in FIG. 6 is the length direction of the connector C2 and corresponds to the first direction in the claims. In the Y-Y' direction, the Y direction of corresponds to one side in the first direction in the claims, and the Y' direction corresponds to the other side in the first direction in the claims. The Z-Z' direction is the height direction of the connector C2 and corresponds to the second direction in the claims. In the Z-Z' direction, the Z direction corresponds to one side in the second direction in the claims, and the Z' direction corresponds to the other side in the second direction in the claims. Although not shown in FIG. 6, the X-X' direction is the width direction of the connector C2 and corresponds to the third direction in the claims. In the X-X' direction, the X direction corresponds to one side in the third direction, and the X' direction corresponds to the other side in the third direction. The Z-Z' direction is substantially perpendicular to the Y-Y' direction. The X-X' direction is substantially perpendicular to the Y-Y' and Z-Z' directions.

The body 200' is a block made of an insulation resin. The body 200' includes a main body, a cover (not shown), an accommodation hole 210*a*', a cable accommodation hole 220*a*', and an insertion hole 230*a*'.

The accommodation hole 210*a*' extends in the Y-Y' direction inside the main body. The accommodation hole 210*a*' has an opening that is open in the X' direction and covered by the cover. The accommodation hole 210*a*' includes a first portion 211*a*', a second portion 212*a*', a third portion 213*a*', and a fourth portion 214*a*'. The first portion 211*a*' is the Y' direction end portion of the accommodation hole 210*a*'. The first portion 211*a*' has the same configuration as each first portion 211*a* of Embodiment 1. The first portion 211*a*' includes a wall surface 211*a*1' on the Z-direction side, a wall surface 211*a*2' on the Z'-direction side, a wall surface on the X-direction side, and a wall surface on the X'-direction side (part of the cover). The second portion 212*a*' is the Y direction end portion of the accommodation hole 210*a*'. The second portion 212*a*' is larger than the first portion 211*a*' in Z-Z' direction dimension and as large as the first portion 211*a*' in X-X' direction dimension. The second portion 212*a*' includes a wall surface 212*a*1' on the Z-direction side, a wall surface 212*a*2' on the Z'-direction side, a wall surface on the X-direction side, and a wall surface on the X'-direction side (part of the cover). The third portion 213*a*' and the fourth portion 214*a*' are provided between the first and second portions 211*a*' and 212*a*'. The third portion 213*a*' is located on the first portion 211*a*' side with respect to the fourth portion 214*a*'. The third portion 213*a*' is as large as the first portion 211*a*' in Z-Z' direction dimension and also in X-X' direction dimension. The third portion 213*a*' has a wall surface on the Z-direction side, a wall surface on the Z'-direction side, a wall surface on the X-direction side, and a wall surface on the X'-direction side (part of the cover). The fourth portion 214*a*' is located on the second portion 212*a*' side with respect to the third portion 213*a*'. The fourth portion 214*a*' is larger than the second portion 212*a*' in Z-Z' direction dimension and as large as the second portion 212*a*' in X-X' direction dimension. The fourth portion 214*a*' has a wall surface 214*a*1' on the Z-direction side, a wall surface 214*a*2' on the Z'-direction side, a wall surface on the X-direction side, and a wall surface on the X'-direction side (part of the cover).

The cable accommodation hole 220*a*' is provided in the main body, on the Y'-direction side with respect to the accommodation hole 210*a*', so as to communicate with the accommodation hole 210*a*'. The cable accommodation hole 220*a*' is open in the Y' and X' directions. The opening in the X' direction of the cable accommodation hole 220*a*' is covered by the cover. The insertion hole 230*a*' is provided in the body 200', on the Y-direction side with respect to the accommodation hole 210*a*', so as to communicate with the accommodation hole 210*a*'.

The terminal 100*a*' is made of a metal plate. The terminal 100*a*' includes a first fixable portion 110*a*', a second fixable portion 120*a*', a joining portion 130*a*', a first contacting portion 140*a*', a second contacting portion 150*a*', a connectable portion 160*a*', a holding portion 170*a*', first and second biasing portions 181*a*' and 182*a*', and first and second abuttable portions 191*a*' and 192*a*'.

The first fixable portion 110*a*', having the same configuration as each first fixable portion 110*a* of Embodiment 1, is fixed to the first portion 211*a*' of the accommodation hole 210*a*' with respect to the Z-Z' and X-X' directions. For brevity, the first fixable portion 110*a*' will not be described below for overlaps the first fixable portion 110*a* of Embodiment 1.

The second fixable portion 120*a*' is a metal plate of generally C-shaped cross section. The second fixable portion 120*a*' has substantially the same configuration as the second fixable portion 120*a* of Embodiment 1. The only difference is that the second fixable portion 120*a*' includes a base 121*a*' that is larger in Z-Z' direction dimension than the base 121*a* of the second fixable portion 120*a*. For brevity, the second fixable portion 120*a*' will not be described below for overlaps the second fixable portion 120*a* of Embodiment The base 121*a*' is larger in Z-Z' direction dimension than the base 111*a*' of the first fixable portion 110*a*'. The first projection 122*a*' is located on the Z-direction side with respect to the first contacting portion 140*a*', and the second projection 122*a*' is located on the Z'-direction side with respect to the second contacting portion 150*a*'.

The second fixable portion 120*a*' has (i) a dimension in the Z-Z' direction and (ii) a dimension in the X-X' direction as defined below that are suitable for fixing the second fixable portion 120*a*' in the second portion 212*a*' of the accommodation hole 210*a*'. (i) The Z-Z' direction dimension is the distance in the Z-Z' direction between the outer faces (the upper and lower faces as shown) of the first and second projections 122*a*'. This distance is substantially the same as or slightly smaller than the Z-Z' direction dimension of the second portion 212*a*' of the accommodation hole 210*a*'. Accordingly, the outer face of the first projection 122*a*' abuts the wall surface 212*a*1' on the Z-direction side of the second portion 212*a*', and the outer face of the second projection 122*a*' abuts the wall surface 212*a*2' on the Z'-direction side of the second portion 212*a*'. (ii) The X-X' direction dimension is the sum of the X-X' direction dimension of the base 121*a*' and the X-X' direction dimension of each projection 122*a*'. This dimension is substantially the same as or slightly smaller than the X-X' direction dimension of the second portion 212*a*' of the accommodation hole 210*a*'. Accordingly, the base 121*a*' abuts the wall surface on the X-direction side of the second portion 212*a*', and the end faces in the X' direction of the first and second projections 122*a*' abut the wall surface on the X'-direction side of the second portion 212*a*.

The joining portion 130*a*' has the same configuration as the joining portion 130*a* of Embodiment 1. The joining portion 130*a*' joins the first and second fixable portions 110*a*' to 120*a*'. The first contacting portion 140*a*' has the same configuration as each first contacting portion 140*a* of Embodiment 1. The second contacting portion 150*a*' has the same configuration as each second contacting portion 150*a* of Embodiment 1. The connectable portion 160*a* has the same configuration as each connectable portion 160*a* of Embodiment 1, and it is connected to a core wire of the cable. The holding portion 170*a* has the same configuration as each holding portion 170*a* of Embodiment 1 and holds the cable. These constituents will not be described below for overlaps with the corresponding constituents of Embodiment 1.

The first biasing portion 181*a*' is a metal plate extending from the first projection 122*a*' to the Y'-direction side (the first fixable portion 110*a*' side) so as to be located on the Z-direction side with respect to the first contacting portion 140*a*'. The first biasing portion 181*a* is smaller in Y-Y' direction dimension than the fourth portion 214*a*' of the accommodation hole 210*a*. The first biasing portion 181*a*' is located inside the fourth portion 214*a*', in spaced relation in the Z-Z' direction to the wall surface 214*a*1' on the Z-direction side. The first biasing portion 181*a*' is resiliently deformable from its neutral position to the Z-direction side. The first biasing portion 181*a*' in the neutral position extends substantially in parallel to the wall surface 214*a*1'.

The second biasing portion 182*a*' is a metal plate extending from the second projection 122*a*' to the Y'-direction side (the first fixable portion 110*a*' side) so as to be located on the Z'-direction side with respect to the second contacting portion 150*a*'. The second biasing portion 182*a* is smaller in Y-Y' direction dimension than the fourth portion 214*a*' of the accommodation hole 210*a*. The second biasing portion 182*a*' is located inside the fourth portion 214*a*', in spaced relation in the Z-Z' direction to the wall surface 214*a*2' on the Z'-direction side. The second biasing portion 182*a*' is resiliently deformable from its neutral position to the Z'-direction side. The second biasing portion 182*a*' in the neutral position extends substantially in parallel to the wall surface 214*a*2'.

The first abuttable portion 191*a*' is a metal plate extending from the first biasing portion 181*a*' in the Z' direction. The first abuttable portion 191*a*' is located inside the fourth portion 214*a*', in spaced relation to the first contacting portion 140*a*'. The first abuttable portion 191*a*' can be shifted in the Z direction in accordance with the resilient deformation of the first biasing portion 181*a*'.

The second abuttable portion 192*a*' is a metal plate extending from the second biasing portion 182*a*' in the Z direction. The second abuttable portion 192*a*' is located inside the fourth portion 214*a*', in spaced relation to the second contacting portion 150*a*'. The second abuttable portion 192*a*' can be shifted in the Z' direction in accordance with the resilient deformation of the second biasing portion 182*a*'.

The terminal 100*a*' configured as described above may be inserted in the following steps into the accommodation hole 210*a*' and the cable accommodation hole 220*a*' of the body 200'. First, the terminal 100*a*' and the cable are prepared. The core wire of the cable is fixed at its portion protruding from the insulator to the connectable portion 160*a*' of the terminal 100*a*' by press-fitting or soldering. The insulator of the cable is then held by the holding portion 170*a*' of the terminal 100*a*'. The main body is also prepared. The terminal 100*a*' is inserted from the X' direction into the accommodation hole 210*a*' and the cable accommodation hole 220*a*' of the main body. Simultaneously, the first and second projections 122*a*' of the second fixable portion 120*a*' of the terminal 100*a*' are slid on and along the wall surfaces 212*a*1' and 212*a*2' of the second portion 212*a*' to be accommodated into the second portion 212*a*'. The first and second projections 112*a*' of the first fixable portion 110*a*' of the terminal 100*a*' are slid on and along the wall surfaces 211*a*1' and 211*a*2' of the first portion 211*a*' to be accommodated into the first portion 211*a*'. The joining portion 130*a*' and the first and second contacting portions 140*a*' and 150*a*' are accommodated into the third and fourth portions 213*a*' and 214*a*' of the accommodation hole 210*a*', without contacting the wall surfaces in the Z-Z' and X-X' directions of the third and fourth portions 213*a*' and 214*a*'. The first and second biasing portions 181*a*' and 182*a*' and the first and second abuttable portions 191*a*' and 192*a*' are accommodated into the third portion 213*a*' of the accommodation hole 210*a*', without contacting the wall surfaces in the Z-Z' and X-X' directions of the third portion 213*a*'. The connectable portion 160*a*', the holding portion 170*a*', and part of the cable held by the connectable portion 160*a*' and the holding portion 170*a*' are accommodated in the cable accommodation hole 220*a*'. The cover is prepared and fixed to the main body so as to cover the accommodation hole 210*a*' and the cable accommodation hole 220*a*'.

When the second fixable portion 120*a*', the joining portion 130*a*', the first and second contacting portions 140*a*' and 150*a*', the first and second biasing portions 181*a*' and 182*a*', the first and second abuttable portions 191*a*' and 192*a*', and the first fixable portion 110*a*' of the terminal 100*a*' are accommodated in the accommodation hole 210*a*' in the following arrangement: The outer face of the first projection 122*a*' of the second fixable portion 120*a*' abuts the wall surface 212*a*1' on the Z-direction side of the second portion 212*a*', and the outer face of the second projection 122*a*' abuts the wall surface 212*a*2' on the Z'-direction side of the second portion 212*a*'. Also, the base 121*a*' of the second fixable portion 120*a*' abuts the wall surface on the X-direction side of the second portion 212*a*', and the end faces in the X' direction of the first and second projections 122*a*' abut the wall surface on the X'-direction side of the second portion 212*a*'. The second fixable portion 120*a*' is thus fixed to the second portion 212*a*' of the accommodation hole 210*a*' to be in position with respect to the Z-Z' and X-X' directions. Also, the abutting face of the joining portion 130*a*' abuts the wall surfaces on the X-direction side of the third and fourth portions 213*a*' and 214*a*' of the accommodation hole 210*a*'. The outer face of the first projection 112*a*' of the first fixable portion 110*a*' abuts the wall surface 211*a*1' on the Z-direction side of the first portion 211*a*', and the outer face of the second projection 112*a*' abuts the wall surface 211*a*2' on the Z'-direction side of the first portion 211*a*'. The base 111*a*' of the first fixable portion 110*a*' abuts the wall surface on the X-direction side of the first portion 211*a*', and the end faces in the X' direction of the first and second projections 112*a*' abut the wall surface on the X'-direction side of the first portion 211*a*'. The first fixable portion 110*a*' is thus fixed to the first portion 211*a*' of the accommodation hole 210*a*' to be in position with respect to the Z-Z' and X-X' directions. The free end 142*a*' of the first contacting portion 140*a*' is located on the Z-direction side with respect to the wall surface 231*a*' of the insertion hole 230*a*'. The free end 152*a*' of the second contacting portion 150*a*' is located on the Z'-direction side with respect to the wall surface 232*a*' of the insertion hole 230*a*'. The first biasing portion 181*a*' is located in spaced relation to the wall surface 214*a*1' of the accommodation hole 210*a*'. The second biasing portion 182*a*' is located in spaced relation to the wall surface 214*a*2' of the accommodation hole 210*a'*.

When the connector C2 is connected to a mating connector, the terminal of the mating connector is inserted through the insertion hole 230*a*' of the body 200' into the accommodation hole 210*a*'. The terminal of the mating connector is thus placed between the first and second contacting portions 140*a*' and 150*a*' of the terminal 100*a*' so as to press (apply load to) the contactable portions 143*a*' and 153*a*' of the first and second contacting portions 140*a*' and 150*a*'. As a result, the first and second contacting portions 140*a*' and 150*a*' resiliently deform in directions away from each other. Specifically, the first contacting portion 140*a*' resiliently deforms from its neutral position in the Z direction to press the first abuttable portion 191*a*' in the Z direction. The first abuttable portion 191*a*' is thus shifted in the Z direction, and the first biasing portion 181*a*' resiliently deforms in the Z direction. The second contacting portion 150*a*' resiliently deforms from its neutral position in the Z' direction to press the second abuttable portion 192*a*' in the Z' direction. The second abuttable portion 192*a*' is thus shifted in the Z' direction, and the second biasing portion 182*a*' resiliently deforms in the Z' direction. As a result, the contactable portions 143*a*' and 153*a*' of the first and second contacting portions 140*a*' and 150*a*' holds therebetween the terminal of the mating connector at a large contact pressure. The terminal 100*a*' is thus connected to the terminal of the mating connector.

The connector C2 has at least technical characteristics similar to the first to third and fifth technical characteristics of the connector C1. The connector C2 further has the following technical characteristics. The connector C2 is configured such as to allow insertion of the terminal of the mating connector at light load between the first and second contacting portions 140*a*' and 150*a*' of the terminal 100*a*', while the inserted terminal of the mating connector can held between the first and second contacting portions 140*a*' and 150*a*' with increased contact pressures. The reasons for this are as follows. In the neutral positions, the first and second contacting portions 140*a*' and 150*a*' are not in contact with the first and second abuttable portions 191*a*' and 192*a*'. Accordingly, when the terminal of the mating connector is inserted between the first and second contacting portions 140*a*' and 150*a*' of the terminal 100*a*', the first and second contacting portions 140*a*' and 150*a*' can resiliently deform at light load in the directions away from each other. Once the first and second contacting portions 140*a*' and 150*a*' have deformed, the first and second contacting portions 140*a*' and 150*a*' press the first and second biasing portions 181*a*' and 182*a*' via the first and second abuttable portions 191*a*' and 192*a*' so as to make the first and second biasing portions 181*a*' and 182*a*' resiliently deform. Hence, the biasing forces of the first and second biasing portions 181*a*' and 182*a*' are applied to the first and second contacting portions 140*a*' and 150*a*', so that the terminal of the mating connector can held between the first and second contacting portions 140*a*' and 150*a*' with increased contact pressures.

It should be appreciated that the connector and the terminal of the invention are not limited to the configurations as described by way of the embodiments as described above, but they can be modified in any manner within the scope of claims. Specific modifications will be described below in detail.

The body of the invention can be modified in any manner as long as it has the following requirements. First, the body is made of an insulation resin. Second, the body is provided with an accommodation hole extending in a first direction, and the accommodation hole includes first and second portions spaced from each other in the first direction. The first and second portions of the accommodation hole of the invention may be of the same shape or different shapes from each other. Specifically, the first portion of the accommodation hole of the invention may have any shape adapted to fix the first fixable portion of the terminal of the invention in a second direction crossing the first direction. The second portion of the accommodation hole of the invention may have any shape adapted to fix the second fixable portion of the terminal of the invention in the second direction. The accommodation hole may include another portion between the first and second portions for accommodating at least the joining portion and the first contacting portion of the terminal.

The insertion hole of the body of the invention may be any hole on one side in the first direction with respect to the accommodation hole of the body and in communication with the accommodation hole. The insertion hole may be larger or smaller than or substantially the same as the accommodation hole in dimension in the second direction. Also in dimension in the third direction crossing the first and second directions, the insertion hole may be larger or smaller than or substantially the same as the accommodation hole. The body of the invention may be provided without the cable accommodation hole, the engaging groove, and/or the slit.

The terminal of the invention can be modified in any manner as long as it includes a first fixable portion having a dimension in a second direction crossing a first direction, the dimension allowing the first fixable portion to be fixed to a first portion of an accommodation hole of a body made of an insulation resin, the accommodation hole extending in the first direction; a second fixable portion being spaced from the first fixable portion in the first direction and configured to be fixed to a second portion of the accommodation hole of the body, the second fixable portion having a dimension in the second direction; a joining portion joining the first and second fixable portions and having a dimension in the second direction smaller than the respective dimensions in the second direction of the first and second fixable portions; and a first contacting portion extending from the first fixable portion toward the second fixable portion and is resiliently deformable in the second direction.

The first fixable portion of the terminal of the invention can be modified as long as it has a dimension in the second direction allowing the first fixable portion to be fixed to the first portion of the accommodation hole of the body. For instance, the first fixable portion can only include a base having the dimension in the second direction allowing the first fixable portion to be fixed to the first portion of the accommodation hole of the body. The first fixable portion may have dimensions in the second and third directions allowing the first fixable portion to be fixed to the first portion of the accommodation hole of the body. For instance, the first fixable portion may have a T-shaped or L-shaped cross section including a base and a projection on the base, and the base may have a dimension in the second direction allowing the first fixable portion to be fixed to the first portion of the accommodation hole of the body.

The second fixable portion of the terminal of the invention can be modified as long as it has a dimension in the second direction allowing the second fixable portion to be fixed to the second portion of the accommodation hole of the body. For instance, the second fixable portion can only include a base having the dimension in the second direction allowing the second fixable portion to be fixed to the second portion of the accommodation hole of the body. The second fixable portion may have dimensions in the second and third directions allowing the second fixable portion to be fixed to the second portion of the accommodation hole of the body. For instance, the second fixable portion may have a T-shaped or L-shaped cross section including a base and a projection on the base, and the base may have a dimension in the second direction allowing the second fixable portion to be fixed to the second portion of the accommodation hole of the body.

The joining portion of the terminal of the invention can be modified in any manner as long as it joins the first and second fixable portions and has a dimension in the second direction that is smaller than the respective dimensions in the second direction of the first and second fixable portions. The recess in the abutting face of the joining portion can be omitted. The abutting face of the joining portion may be provided with a hole in place of the recess. The joining portion may be configures such as not to contact any wall surface of the accommodation hole of the body. In addition, the joining portion may be smaller in dimension in the first direction than the first contacting portion. In this case, the second fixable portion may be located on the other side in the first direction with respect to the free end of the first contacting portion.

The first contacting portion of the terminal of the invention can be modified in any manner as long as it extends from the first fixable portion toward the second fixable portion and is resiliently deformable in the second direction. For instance, the first contacting portion may generally have a U-shape extending from the first fixable portion toward the second fixable portion and then curving in the second direction. The first contacting portion may extend from the first fixable portion toward the second fixable portion and then be folded over toward the first fixable portion. The first contacting portion may include a fixed end fixed to the first fixable portion and a free end opposite the fixed end. Alternatively, the first contacting portion may include a fixed end fixed to the first fixable portion, a free end opposite the fixed end, and a contactable portion provided between the fixed end and the free end.

The free end of the first contacting portion may be located on the one or other side in the second direction with respect to the wall surface on the one side in the second direction of the insertion hole of the body, or it may be located along an imaginary line extending in the first direction along the wall surface on the one side in the second direction of the insertion hole of the body. The free end of the first contacting portion in the neutral position may be located to be spaced apart from or in abutment with the wall surface on the one side in the second direction of the accommodation hole of the body. The distance in the second direction from the fixed end to the contactable portion may be larger than, smaller than, or substantially the same as the distance in the second direction from the free end to the contactable portion.

The second contacting portion of the terminal of the invention can be omitted. The second contacting portion of the terminal of the invention can be modified in any manner as long as it extends from the first fixable portion toward the second fixable portion and is resiliently deformable in the second direction. For instance, the second contacting portion may generally have a U-shape extending from the first fixable portion toward the second fixable portion and then curving in the second direction. The first contacting portion may extend from the first fixable portion toward the second fixable portion and then be folded over toward the first fixable portion. The second contacting portion may include a fixed end fixed to the second fixable portion and a free end opposite the fixed end. Alternatively, the second contacting portion may include a fixed end fixed to the second fixable portion, a free end opposite the fixed end, and a contactable portion provided between the fixed end and the free end.

The free end of the second contacting portion may be located on the one or other side in the second direction with respect to the wall surface on the other side in the second direction of the insertion hole of the body, or it may be located along an imaginary line extending in the first direction along the wall surface on the other side in the second direction of the insertion hole of the body. The free end of the second contacting portion in the neutral position may be located to be spaced apart from or in abutment with the wall surface on the other side in the second direction of the accommodation hole of the body. The distance in the second direction from the fixed end to the contactable portion may be larger than, smaller than, or substantially the same as the distance in the second direction from the free end to the contactable portion.

The contactable portion of the first contacting portion can be located on the one or other side in the first direction with respect to the contactable portion of the second contacting portion. In other words, the first and second contacting portions may have different shapes from each other. In this case, the first and second contacting portions are different in natural frequency. Therefore, even when the first and second contacting portions resiliently holding therebetween the terminal of the mating connector are subjected to vibration and/or physical shock, there is an increased possibility of maintaining connection between at least one of the first and second contacting portions and the terminal of the mating connector.

The connectable portion of the terminal of the invention can be omitted. In this case, the terminal may be connected to the substrate. The holding portion of the terminal of the invention can also be omitted. The cable of the invention can be omitted.

The first and second biasing portions of the terminal of the invention can be omitted. When the second contacting portion is omitted as described above, it is possible to omit the second biasing portion only. The first biasing portion can be modified in any manner as long as it extends from the second fixable portion toward the first fixable portion so as to be located on the one side in the second direction of the first contacting portion and the first biasing portion is resiliently deformable to the one side in the second direction when the first contacting portion resiliently deforms to the one side in the second direction and presses the first biasing portion to the one side directly or indirectly in the second direction. For instance, the first biasing portion may have a bent or curved shape such as to be directly pressed by the first contacting portion as resiliently deformed to the one side in the second direction. Likewise, the second biasing portion can be modified in any of the above manners. The first and second biasing portions may have a same shape or different shapes from each other. Further, if the first and second biasing portions are directly pressed by the first and second contacting portions, the first and second abuttable portions can be omitted.

The shield case of the invention can be omitted. The shield case can be any shield case adapted to cover the outer periphery of the body. The case of the invention can be omitted.

It should be appreciated that the connector and the terminal of the above embodiments and modifications are described above by way of examples only and may comprise any materials, shapes, dimensions, numbers, arrangements, and other configurations if they can perform similar functions. The configurations of the embodiment and the modifications described above may be combined in any possible manner. The first direction of the invention may be any length direction of the accommodation hole of the body. The second direction of the invention may be any direction crossing the first direction. The third direction of the invention may be any direction crossing the first and second directions.

REFERENCE SIGNS LIST

100*a*, 100*b*: Terminal
- 10*a*, 110*b*: First fixable portion
  - 111*a*: Base
  - 112*a*: Projection
- 120*a*, 120*b*: Second fixable portion
  - 121*a*: Base
  - 122*a*: Projection
- 130*a*, 130*b*: Joining portion
  - 131*a*, 131*b*: Abutting face
  - 132*a*, 132*b*: Recess
- 140*a*, 140*b*: First contacting portion
  - 141*a*, 141*b*: Fixed end
  - 142*a*, 142*b*: Free end
  - 143*a*, 143*b*: Contactable portion
- 150*a*, 150*b*: Second contacting portion
  - 151*a*, 151*b*: Fixed end
  - 152*a*, 152*b*: Free end
  - 153*a*, 153*b*: Contactable portion
- 160*a*, 160*b*: Connectable portion
- 170*a*. 170*b*: Holding portion
- 181*a*. 181*b*; First and second biasing portions

200: Body
- 210*a*, 210*b*: Accommodation hole
  - 211*a*, 211*b*: First portion
  - 212*a*, 212*b*: Second portion
  - 213*a*, 213*b*: Third portion
- 220*a*, 220*b*: Cable accommodation hole
- 230*a*. 230*b*: Insertion hole
- 240*a*, 240*b*: Engaging groove
- 250: Slit

300: Shield plate
400: Shield case
500: Cable
600: Ring
700: Case

The invention claimed is:

1. A terminal comprising:

a first fixable portion having a dimension in a second direction crossing a first direction, the dimension allowing the first fixable portion to be fixed to a first portion of an accommodation hole of a body made of an insulation resin, the accommodation hole extending in the first direction;

a second fixable portion being spaced from the first fixable portion in the first direction and having a dimension in the second direction allowing the second fixable portion to be fixed to a second portion of the accommodation hole of the body;

a joining portion extending in the first direction from the first fixable portion to the second fixable portion such as to directly join the first and second fixable portions and having a dimension in the second direction that is smaller than the respective dimensions in the second direction of the first and second fixable portions; and a first contacting portion extending from the first fixable portion toward the second fixable portion and being resiliently deformable in the second direction.

2. The terminal according to claim 1, wherein a dimension in the first direction of the joining portion is larger than a dimension in the first direction of the first contacting portion, and the second fixable portion is located on one side in the first direction with respect to the first contacting portion.

3. The terminal according to claim 1, wherein the second fixable portion includes a base and a projection on the base, and a sum of a dimension in a third direction of the base and a dimension in the third direction of the projection is substantially the same as or slightly larger than a dimension in the third direction of the second portion of the accommodation hole, and the third direction crosses the first and second directions.

4. The terminal according to claim 1, further comprising:

a first biasing portion extending from the second fixable portion toward the first fixable portion so as to be located on one side in the second direction of the first contacting portion, the first biasing portion being resiliently deformable to the one side in the second direction when the first contacting portion resiliently deforms to the one side in the second direction and presses the first biasing portion to the one side in the second direction.

5. The terminal according to claim 1, further comprising a connectable portion to be connected to a cable.

6. A connector comprising:

the terminal according to claim 1; and a body being made of an insulation resin and including an accommodation hole, the accommodation hole extending in the first direction and accommodating the terminal.

7. A connector comprising:

the terminal according to claim 1; and a body made of an insulation resin, wherein the second direction includes one side and the other side, the first contacting portion of the terminal includes:

a fixed end fixed to the first fixable portion, a free end opposite to the fixed end, and a contactable portion between the fixed end and the free end, the contactable portion being located on the other side in the second direction with respect to the fixed end and the free end, the body includes:

an accommodation hole extending in the first direction and accommodating the terminal, and an insertion hole on the one side in the first direction with respect to the accommodation hole of the body, and the insertion hole includes a wall surface on the one side in the second direction, the wall surface being located on the other side in the second direction with respect to the free end of the first contacting portion.

8. A terminal comprising:

a first fixable portion having a dimension in a second direction crossing a first direction, the dimension allowing the first fixable portion to be fixed to a first portion of an accommodation hole of a body made of an insulation resin, the accommodation hole extending in the first direction;

a second fixable portion being spaced from the first fixable portion in the first direction and having a dimension in the second direction allowing the second fixable portion to be fixed to a second portion of the accommodation hole of the body;

a joining portion joining the first and second fixable portions and having a dimension in the second direction that is smaller than the respective dimensions in the second direction of the first and second fixable portions; and a first contacting portion extending from the first fixable portion toward the second fixable portion and being resiliently deformable in the second direction, wherein the first fixable portion includes a base, and a projection on the base of the first fixable portion, and a sum of a dimension in the third direction of the base of the first fixable portion and a dimension in the third direction of the projection of the first fixable portion is substantially the same as or slightly larger than a dimension in the third direction of the first portion of the accommodation hole, and the third direction crosses the first and second directions.

9. The terminal according to claim 8, wherein the base of the first fixable portion includes a first end on one side in the second direction, and a second end on the other side in the second direction, the projection of the first fixable portion comprises first and second projections, the first projection is provided at the first end of the base of the first fixable portion, and the second projection is provided at the second end of the base of the first fixable portion, and a distance in the second direction from an outer face of the first projection to an outer face of the second projection is substantially the same as or slightly larger than the dimension in the second direction of the first portion of the accommodation hole of the body.

10. The terminal according to claim 8, wherein the first contacting portion includes:

a fixed end fixed to the projection, and a free end opposite the fixed end of the first contacting portion, wherein a relative positioning of the free end and a wall surface on one side in the second direction of the accommodation hole of the body is such that:

(a) when the first contacting portion is located in an neutral position, there is a clearance between the free end and the wall surface on the one side, and (b) when the first contacting portion resiliently deforms from the neutral position to the one side in the second direction, the free end abuts the wall surface on the one side.

11. The terminal according to claim 10, wherein the first contacting portion further includes a contactable portion between the fixed end and the free end, the contactable portion being located on the other side in the second direction with respect to the fixed end and the free end, and a distance in the first direction from the fixed end to the contactable portion is larger than a distance in the first direction from the free end to the contactable portion.

12. The terminal according to claim 10, wherein the first contacting portion further includes a contactable portion between the fixed end and the free end, the contactable portion being located on the other side in the second direction with respect to the fixed end and the free end, and a distance in the first direction from the fixed end to the contactable portion is smaller than a distance in the first direction from the free end to the contactable portion.

13. The terminal according to claim 8, further comprising:

a second contacting portion, wherein the projection of the first fixable portion comprises first and second projections, the first contacting portion extends from the first projection toward the second fixable portion and is resiliently deformable to one side in the second direction, and the second contacting portion extends from the second projection toward the second fixable portion and is resiliently deformable to the other side in the second direction.

14. The terminal according to claim 13, further comprising:

a first biasing portion extending from the second fixable portion toward the first fixable portion so as to be located on the one side in the second direction of the first contacting portion, the first biasing portion being resiliently deformable to the one side in the second direction when the first contacting portion resiliently deforms to the one side in the second direction and presses the first biasing portion to the one side in the second direction; and a second biasing portion extending from the second fixable portion toward the first fixable portion so as to be located on the other side in the second direction of the second contacting portion, the second biasing portion being resiliently deformable to the other side in the second direction when the second contacting portion resiliently deforms to the other side in the second direction and presses the second biasing portion to the other side in the second direction.

15. A connector comprising:

the terminal according to claim 13; and a body made of an insulation resin, wherein the second direction includes one side and the other side, the first and second contacting portions of the terminal each include:

a fixed end fixed to the first fixable portion, a free end opposite to the fixed end, and a contactable portion between the fixed end and the free end, the contactable portion of the first contacting portion is located on the other side in the second direction with respect to the fixed end and the free end of the first contacting portion, the contactable portion of the second contacting portion is located on the one side in the second direction with respect to the fixed end and the free end of the second contacting portion, the body includes:

an accommodation hole extending in the first direction and accommodating the terminal, and an insertion hole on the one side in the first direction with respect to the accommodation hole of the body, and the insertion hole includes:

a wall surface on the one side in the second direction located on the other side in the second direction with respect to the free end of the first contacting portion, and a wall surface on the other side in the second direction located on the one side in the second direction with respect to the free end of the second contacting portion.

16. The terminal according to claim 13, wherein the first contacting portion includes:

a fixed end fixed to the first projection, and a free end opposite the fixed end of the first contacting portion, wherein a relative positioning of the free end and a wall surface on the one side in the second direction of the accommodation hole of the body is such that:

(a) when the first contacting portion is located in a neutral position, there is a clearance between the free end and the wall surface on the one side, and (b) when the first contacting portion resiliently deforms from the neutral position thereof to the one side in the second direction, the free end abuts the wall surface on the one side, and the second contacting portion includes:

a fixed end fixed to the second projection, and a free end opposite the fixed end of the second contacting portion, wherein a relative positioning of the free end of the second contacting portion and a wall surface on the other side in the second direction of the accommodation hole of the body is such that:

(a) when the second contacting portion is located in a neutral position, there is a clearance between the free end of the second contacting portion and the wall surface on the other side, and (b) when the second contacting portion resiliently deforms from the neutral position thereof to the other side in the second direction, the free end of the second contacting portion abuts the wall surface on the other side.

17. The terminal according to claim 16, wherein the first contacting portion further includes a contactable portion provided between the fixed end and the free end, the contactable portion of the first contacting portion being located on the other side in the second direction with respect to the fixed end and the free end of the first contacting portion, a distance in the first direction from the fixed end to the contactable portion of the first contacting portion is larger than a distance in the first direction from the free end to the contactable portion of the first contacting portion, and the second contacting portion further includes a contactable portion provided between the fixed end and the free end, the contactable portion of the second contacting portion being located on the one side in the second direction with respect to the fixed end and the free end of the second contacting portion, a distance in the first direction from the fixed end to the contactable portion of the second contacting portion is larger than a distance in the first direction from the free end to the contactable portion of the second contacting portion.

18. The terminal according to claim 16, wherein the first contacting portion further includes a contactable portion provided between the fixed end and the free end, the contactable portion of the first contacting portion being located on the other side in the second direction with respect to the fixed end and the free end of the first contacting portion, a distance in the first direction from the fixed end to the contactable portion of the first contacting portion is smaller than a distance in the first direction from the free end to the contactable portion of the first contacting portion, and the second contacting portion further includes a contactable portion provided between the fixed end and the free end, the contactable portion of the second contacting portion being located on the one side in the second direction with respect to the fixed end and the free end of the second contacting portion, a distance in the first direction from the fixed end to the contactable portion of the second contacting portion is smaller than a distance in the first direction from the free end to the contactable portion of the second contacting portion.

19. The terminal according to claim 16, wherein the first contacting portion further includes a contactable portion between the fixed end and the free end, the contactable portion of the first contacting portion being located on the other side in the second direction with respect to the fixed end and the free end of the first contacting portion, the second contacting portion further includes a contactable portion between the fixed end and the free end, the contactable portion of the second contacting portion being located on the one side in the second direction with respect to the fixed end and the free end of the second contacting portion, and the contactable portion of the first contacting portion is located on the one side or the other side in the first direction with respect to the contactable portion of the second contacting portion.

20. A terminal comprising:

a first fixable portion having a dimension in a second direction crossing a first direction, the dimension allowing the first fixable portion to be fixed to a first portion of an accommodation hole of a body made of an insulation resin, the accommodation hole extending in the first direction;

a second fixable portion being spaced from the first fixable portion in the first direction and having a dimension in the second direction allowing the second fixable portion to be fixed to a second portion of the accommodation hole of the body;

a joining portion joining the first and second fixable portions and having a dimension in the second direction that is smaller than the respective dimensions in the second direction of the first and second fixable portions; and a first contacting portion extending from the first fixable portion toward the second fixable portion and being resiliently deformable in the second direction, wherein the joining portion includes an abutting face to abut a wall surface of the accommodation hole of the body, the abutting face including a recess or a hole.

* * * * *